US012397335B2

(12) United States Patent
Onagi

(10) Patent No.: US 12,397,335 B2
(45) Date of Patent: Aug. 26, 2025

(54) BENDING SYSTEM

(71) Applicant: AMADA CO., LTD., Kanagawa (JP)

(72) Inventor: Yousuke Onagi, Kanagawa (JP)

(73) Assignee: AMADA CO., LTD., Kanagawa (JP)

( * ) Notice: Subject to any disclaimer, the term of this patent is extended or adjusted under 35 U.S.C. 154(b) by 921 days.

(21) Appl. No.: 17/615,616

(22) PCT Filed: Jun. 3, 2020

(86) PCT No.: PCT/JP2020/021960
§ 371 (c)(1),
(2) Date: Dec. 1, 2021

(87) PCT Pub. No.: WO2020/246507
PCT Pub. Date: Dec. 10, 2020

(65) Prior Publication Data

US 2022/0234088 A1 Jul. 28, 2022

(30) Foreign Application Priority Data

Jun. 7, 2019 (JP) ..... 2019-107126
May 28, 2020 (JP) ..... 2020-093079

(51) Int. Cl.
*B21D 5/02* (2006.01)
*B21D 5/00* (2006.01)
(Continued)

(52) U.S. Cl.
CPC ..... *B21D 5/004* (2013.01); *B21D 5/0254* (2013.01); *B21D 37/04* (2013.01); *B21D 37/145* (2013.01);
(Continued)

(58) Field of Classification Search
CPC ..... B21D 5/02; B21D 5/0254; B21D 37/04; B21D 37/145; B21D 5/004;
(Continued)

(56) References Cited

U.S. PATENT DOCUMENTS 7,437,210 B1 * 10/2008 Shigefuji ..... B21D 28/12 83/13
7,730,816 B2 * 6/2010 Yamamoto ..... B21D 28/246 83/684
(Continued)

FOREIGN PATENT DOCUMENTS

DE 3830488 A1 * 3/1990 ..... B21D 5/0209
EP 1520641 A1 * 4/2005 ..... B21D 55/00
(Continued)

OTHER PUBLICATIONS

EPO Machine Translation of JP2013-173172 A—Kubota, Teruyuki; "System and Method of Detecting Die"; which JP '172 was published (Year: Sep. 5, 2013).*
(Continued)

*Primary Examiner* — Sunil K Singh
*Assistant Examiner* — Michael Vitale
(74) *Attorney, Agent, or Firm* — Renner, Otto, Boisselle & Sklar, LLP

(57) ABSTRACT

On a back side of a table, moving bodies are provided being movable in a left-right direction. A bending system includes moving actuators to cause the moving bodies to move in the left-right direction relative to the table and position detectors to detect positions of the moving bodies in the left-right direction. The moving bodies are provided with hole detectors to detect the engagement holes of tools fitted to a tool holder. The bending system includes a hole position acquisition unit to acquire positions of the engagement holes of the tools in the left-right direction, based on positions of the moving bodies in the left-right direction at the time of the engagement holes of the tools being detected.

6 Claims, 19 Drawing Sheets

(51) Int. Cl.
*B21D 37/04* (2006.01)
*B21D 37/14* (2006.01)

(52) U.S. Cl.
CPC ..... *Y10T 483/136* (2015.01); *Y10T 483/1731* (2015.01)

(58) Field of Classification Search
CPC ..... Y10T 483/13–138; Y10T 483/1729; Y10T 483/1731
USPC ..... 483/28, 29, 7–11
See application file for complete search history.

(56) References Cited

U.S. PATENT DOCUMENTS

| | | | | |
|---|---|---|---|---|
| 2003/0064871 | A1 | 4/2003 | Akami | |
| 2003/0069114 | A1 | 4/2003 | Akami | |
| 2003/0092547 | A1 | 5/2003 | Akami | |
| 2004/0157715 | A1 | 8/2004 | Akami | |
| 2007/0297889 | A1* | 12/2007 | Rouweler | B25J 15/04 414/733 |
| 2013/0327104 | A1 | 12/2013 | Haselboeck | |
| 2020/0114407 | A1* | 4/2020 | Fabris | B21D 5/0254 |

FOREIGN PATENT DOCUMENTS

| | | | | | |
|---|---|---|---|---|---|
| JP | 2003-71519 | A | | 3/2003 | |
| JP | 2005074446 | A | * | 3/2005 | |
| JP | 2009-285713 | A | | 12/2009 | |
| JP | 4558852 | B2 | | 10/2010 | |
| JP | 4672868 | B2 | * | 4/2011 | B21D 5/02 |
| JP | 2013-173172 | A | | 9/2013 | |
| JP | 5947861 | B2 | | 7/2016 | |
| JP | 2019130567 | A | * | 8/2019 | B21D 37/145 |
| WO | 2018/065965 | A1 | | 4/2018 | |

OTHER PUBLICATIONS

International Search Report for corresponding Application No. PCT/JP2020/021960, mailed Aug. 25, 2020.
Written Opinion for corresponding Application No. PCT/JP2020/021960, mailed Aug. 25, 2020.
Official Action issued in the counterpart Japanese Application No. 2020-093079, drafted Aug. 7, 2020.
Extended European Search Report for corresponding EP Application No. 20818856.5 issued Jul. 6, 2022.

* cited by examiner (a)

(b)

(a)

(b)

(a)

(b)

(a)

(b)

(a)

(b)

BENDING SYSTEM

TECHNICAL FIELD

The present disclosure relates to a bending system for performing bending for a plate-shaped workpiece (a sheet metal).

BACKGROUND ART

A bending system includes a press brake to perform bending for a workpiece, and the press brake includes upper and lower tables and tool holders provided on the respective tables and configured to retain tools. Further, the bending system includes a tool rack arranged on the side of the press brake and configured to store a plurality of tools. The tool rack has a plurality of stockers for retaining tools in which selected arbitrary stockers are configured such that the stockers can be positioned at exchange positions for performing tool exchange. Furthermore, the bending system includes tool exchange units for transporting tools between the tool holders and stockers positioned at the exchange positions, and each tool exchange unit has a tool retention member that is engageable with and disengageable from an engagement hole of a tool (see Patent Literature 1).

As prior-art techniques related to the present disclosure, techniques shown in Patent Literatures 2 to 4 exist in addition to the technique of Patent Literature 1.

CITATION LIST

Patent Literature

Patent Literature 1: Japanese Patent No. 5947861
Patent Literature 2: Japanese Patent No. 4672868
Patent Literature 3: Japanese Patent No. 4558852
Patent Literature 4: Japanese Patent Application Laid-Open Publication No. 2003-71519

SUMMARY

A conventional bending system does not recognize actual positions of tools in a left-right direction on tool holders. Therefore, the conventional bending system has the following problem.

For example, if a tool is fitted to a position deviated from a regular arrangement position on a tool holder corresponding to tool layout information, and engagement or disengagement of a tool retention member with an engagement hole of a tool (a retention operation) fails, an alarm occurs, and an operation related to tool transportation by a tool exchange unit stops. Further, for example, if a clamp plate or a clamper of a tool holder is accidentally released after tools are fitted to the tool holder, there is a possibility that the tools slightly move and are displaced from regular arrangement positions on the tool holder, and, therefore, it is not possible to perform the operation related to tool transportation by a tool exchange unit. Furthermore, for example, tools are randomly laid out on a tool holder by manual work or the like, it is not possible to lay out again the tools at the regular arrangement positions on the tool holder by a tool exchange unit. That is, in the former case, there is a problem that it becomes difficult to stabilize automatic operation of the bending system. Here, the operation related to tool transportation is assumed to include an operation of exchanging tools fitted to a tool holder with tools fitted to a stocker, an operation of retaining a tool by a tool retention member and an operation of laying out tools on a tool holder or a stocker.

In a case where tools are randomly laid out on a tool holder by manual work or the like in a general-purpose bending system without tool exchange units, problems similar to the above also occur.

Therefore, an object of the present disclosure is to provide a bending system capable of accurately recognizing actual positions of tools in a left-right direction on a tool holder or on a stocker.

A bending system according to a first aspect of one or more embodiments includes: a moving body provided on a back side or a front side of a table of a press brake so as to be movable in a left-right direction; a moving actuator configured to cause the moving body to move in the left-right direction relative to the table; and a position detector configured to detect a position of the moving body in the left-right direction. The bending system according to a first embodiment includes: a hole detector provided on the moving body and configured to detect an engagement hole for causing a tool retention member of a tool exchange unit to be engaged and disengaged, the engagement hole being a part of a tool fitted to a tool holder provided on the table; and a hole position acquisition unit configured to acquire a position of the engagement hole of the tool in the left-right direction, based on the position of the moving body in the left-right direction at the time of the engagement hole of the tool being detected.

The bending system according to the first aspect may further include an information reader provided on the moving body and configured to read, from a storage medium provided to the tool, tool information including a width dimension of the tool in the left-right direction and a relative position of the engagement hole in the tool.

According to the first aspect, the moving body is moved in the left-right direction relative to the table by driving of the moving actuator while the position of the moving body in the left-right direction is being detected by the position detector. Further, during the movement of the moving body, the engagement hole of the tool is detected by the tool detector. Then, the hole position acquisition unit acquires the position of the engagement hole of the tool in the left-right direction, based on the position of the moving body in the left-right direction at the time of the engagement hole of the tool being detected. Thereby, the bending system can recognize an actual position of the engagement hole of the tool in the left-right direction on the tool holder.

A bending system according to a second aspect of one or more embodiments further includes: a moving body provided on a back side or a front side of a table of a press brake so as to be movable in a left-right direction; a moving actuator configured to cause the moving body to move in the left-right direction relative to the table; and a position detector configured to detect a position of the moving body in the left-right direction. The bending system according to the second aspect includes: an end face detector provided on the moving body and configured to detect an end face of a tool fitted to a tool holder provided on the table; and an information reader provided on the moving body and configured to read, from a storage medium provided to the tool, tool information including a width dimension of the tool in the left-right direction and a relative position of an engagement hole in the tool, the engagement hole being a part of the tool and being for causing a tool retention member of a tool exchange unit to be engaged and disengaged. The bending system according to the second aspect further includes: a hole position acquisition unit configured to acquire a position of the engagement hole of the tool in the left-right direction, based on the position of the moving body in the left-right direction at the time of the end face of the tool being detected, and the read tool information about the tool.

According to the second aspect, the moving body is moved in the left-right direction by driving of the moving actuator while the position of the moving body in the left-right direction is being detected by the position detector. During the movement of the moving body, the end face of the tool is detected by the tool detector, and the tool information about the tool is read by the information reader. Then, the hole position acquisition unit acquires the position of the engagement hole of the tool in the left-right direction, based on the position of the moving body in the left-right direction at the time of the end face of the tool being detected, and the read tool information about the tool. Thereby, the bending system can recognize an actual position of the engagement hole of the tool in the left-right direction on the tool holder.

A bending system according to a third aspect of one or more embodiments includes: a moving body provided on a back side or a front side of a table of a press brake so as to be movable in a left-right direction; a moving actuator configured to cause the moving body to move in the left-right direction relative to the table; and a position detector configured to detect a position of the moving body in the left-right direction. The bending system according to the third aspect further includes: an end face detector provided on the moving body and configured to detect an end face of a tool fitted to a tool holder provided on the table; and an information reader provided on the moving body and configured to read, from a storage medium provided to the tool, tool information including a width dimension of the tool in the left-right direction. The bending system according to the third aspect further includes a tool position acquisition unit configured to acquire a position of the tool in the left-right direction (a position of the end face of the tool in the left-right direction or a position of the center of the tool in the left-right direction), based on the position of the moving body in the left-right direction at the time of the end face of the tool being detected, and the read tool information about the tool.

According to the third aspect, the moving body is moved in the left-right direction by driving of the moving actuator while the position of the moving body in the left-right direction is being detected by the position detector. During the movement of the moving body, the engagement hole of the tool is detected by the hole detector, and the tool information about the tool is read by the information reader. Then, the tool position acquisition unit acquires the position of the tool in the left-right direction, based on the position of the moving body in the left-right direction at the time of the engagement hole of the tool being detected, and the read tool information about the tool. Thereby, the bending system can recognize an actual position of the tool in the left-right direction on the tool holder.

According to the present disclosure, it is possible to accurately recognize an actual positions of a tool in a left-right direction on a tool holder or stocker.

BRIEF DESCRIPTION OF DRAWINGS

In FIG. 2, a lower joint block and an upper joint block are omitted.

FIG. 4(*b*) is a schematic diagram showing that an inspection beam moves in a left-right direction in the first embodiment.

FIG. 5(*b*) is a schematic diagram showing that a an inspection beam moves in the left-right direction in the first embodiment.

FIGS. 8A(a) and 8A(b) are schematic diagrams illustrating a layout process of the lower tool exchange unit and the like.

FIGS. 8B(a) and 8B(b) are schematic diagrams illustrating a layout process of the lower tool exchange unit and the like.

FIG. 9(*b*) is a schematic diagram showing that an inspection beam moves in the left-right direction in the second embodiment.

FIG. 10(*b*) is a schematic diagram showing that the inspection beam moves in the left-right direction in the second embodiment.

DESCRIPTION OF EMBODIMENTS

Figure 1:
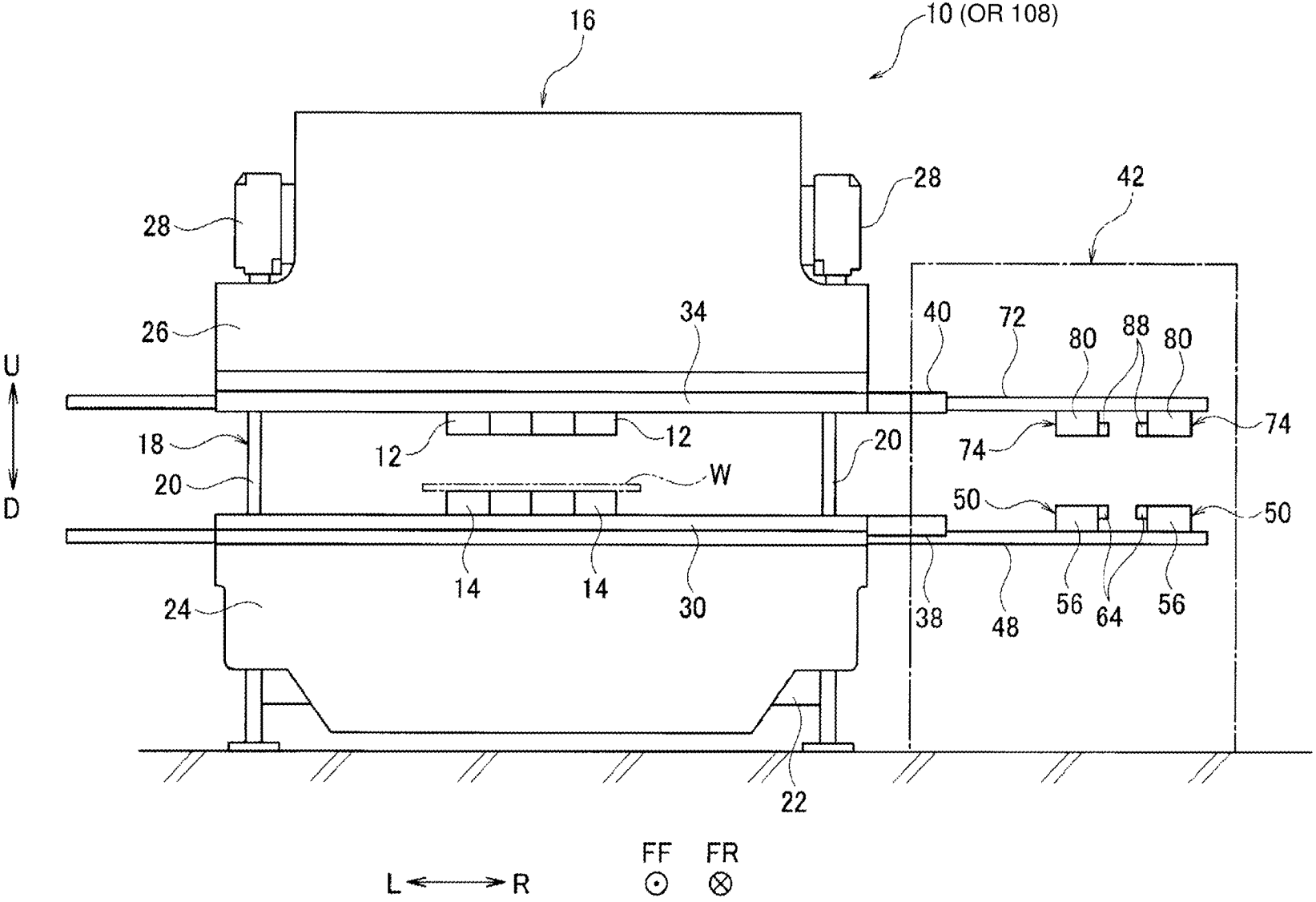
FIG. 1 is a schematic front view of a bending system according to first and second embodiments.

First to fourth embodiments will be explained below with reference to FIGS. 1 to 15.

In the specification and Claims of the present application, "being provided" is assumed to include being indirectly provided via another member in addition to being directly provided. "A left-right direction" is one of horizontal directions and is synonymous with a lateral direction of a press brake, a tool rack, a tool holder or a tool. "A front-back direction" refers to a horizontal direction orthogonal to the left-right direction and is synonymous with a depth direction of the press brake or the tool rack. "Read tool information about a tool" is assumed to include reading identification information about a tool corresponding to tool information about the tool. In the drawings, "FF", "FR", "L", "R", "U" and "D" refer to a front direction, a back direction, a left direction, a right direction, an up direction and a down direction, respectively.

First Embodiment

Figure 2:
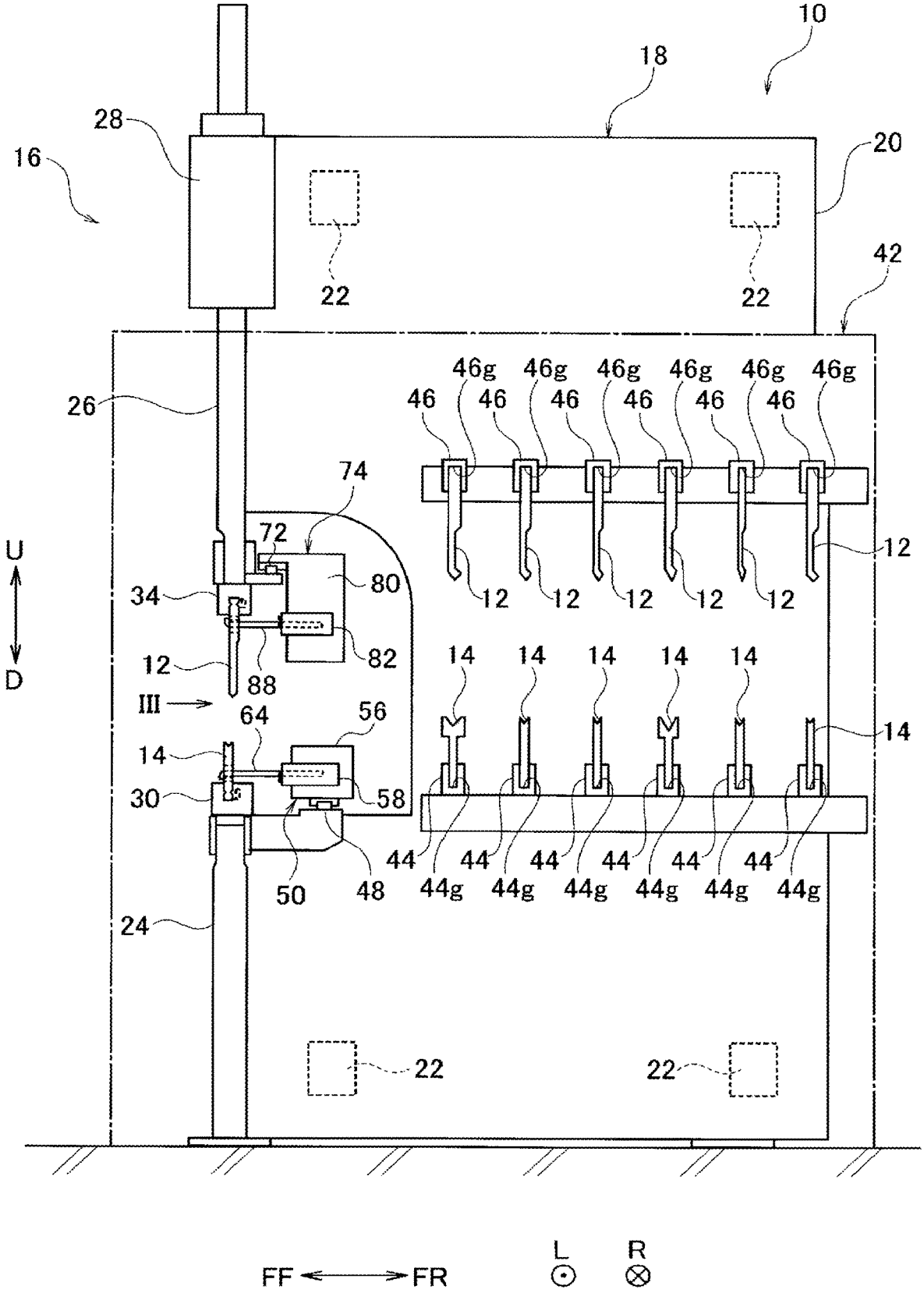
FIG. 2 is a schematic right side view of the bending system according to the first embodiment, and shows that die tools are retained by a lower tool retention member, and punch tools are retained by an upper tool retention member.
Figure 3:
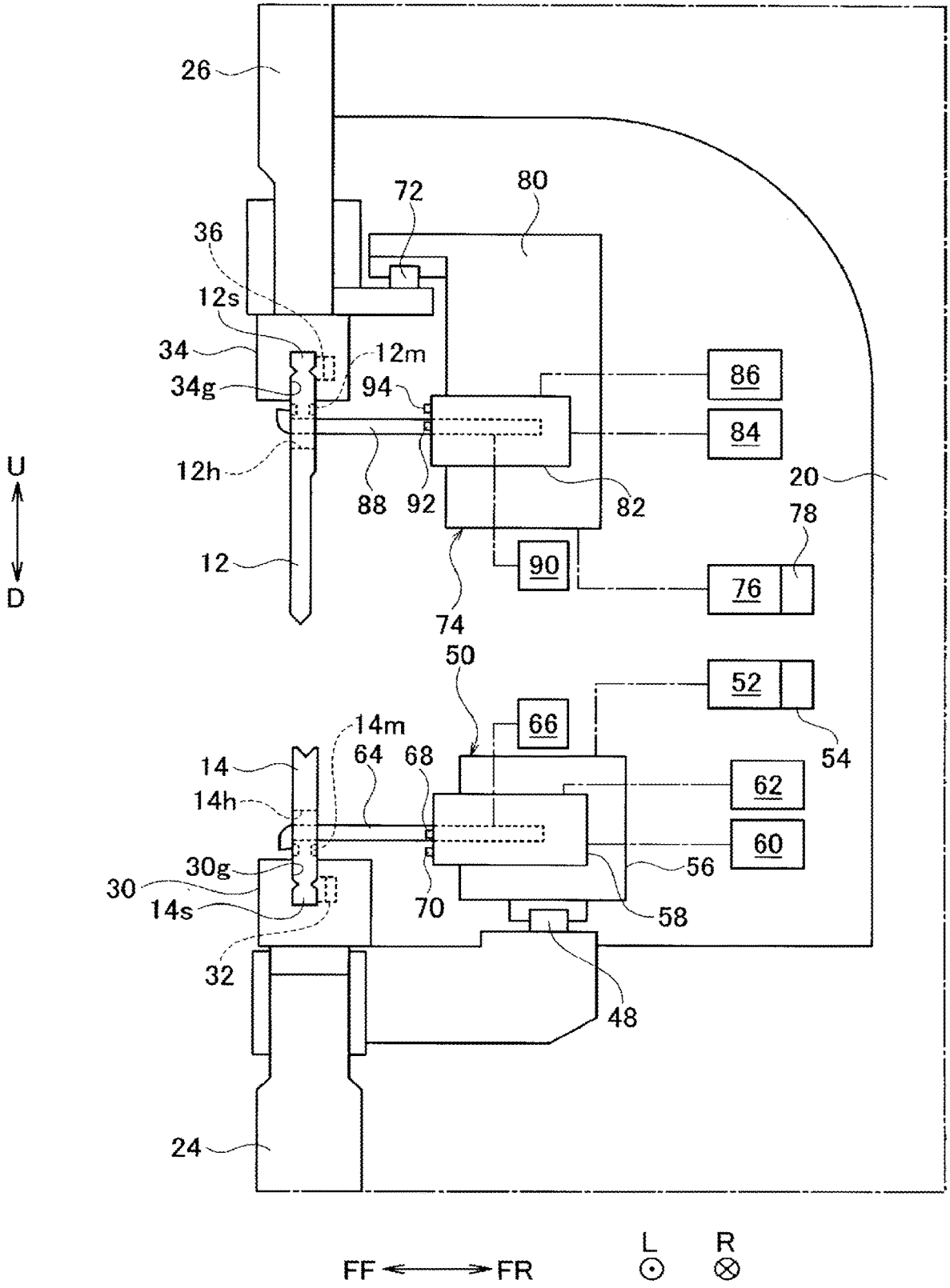
FIG. 3 is an enlarged diagram of a part III in FIG. 2.

As shown in FIGS. 1 to 3, a bending system 10 according to a first embodiment is a system for performing bending for a plate-shaped workpiece (a sheet metal) W using punch tools 12 as automatically exchangeable upper tools and die tools 14 as lower tools. Further, the bending system 10 includes a press brake 16 to perform bending for the workpiece W in cooperation with the punch tools 12 and the die tools 14. First, a configuration of the press brake 16 will be specifically explained.

The press brake 16 includes a main frame 18, and the main frame 18 has a pair of side plates 20 separated in the left-right direction and facing each other, and a plurality of coupling members 22 to couple the pair of side plates 20. Further, at a lower part of the main frame 18, a lower table 24 extending in the left-right direction is provided. At an upper part of the main frame 18, an upper table 26 extending in the left-right direction is provided being movable in a vertical direction. At an upper part of each side plate 20, a hydraulic cylinder 28 is provided as a vertically moving actuator to cause the upper table 26 to move in the vertical direction relative to the main frame 18.

The lower table 24 may be configured to be movable in the vertical direction instead of configuring the upper table 26 to be movable in the vertical direction. As vertically moving actuators, servo motors (not shown) may be used instead of the hydraulic cylinders 28.

On the upper side of the lower table 24, a lower tool holder 30 to removably retain die tools 14 is provided, and the lower tool holder 30 extends in the left-right direction. On the lower tool holder 30, a holder groove 30*g* into which shanks (bases) 14*s* of the die tools 14 are to be inserted is formed along the left-right direction, the holder groove 30*g* being in a publicly known configuration as shown in Patent Literatures 2 and 3. The lower tool holder 30 has a hydraulic clamper 32 to fix the die tools 14 to the lower table 24.

Figure 4:
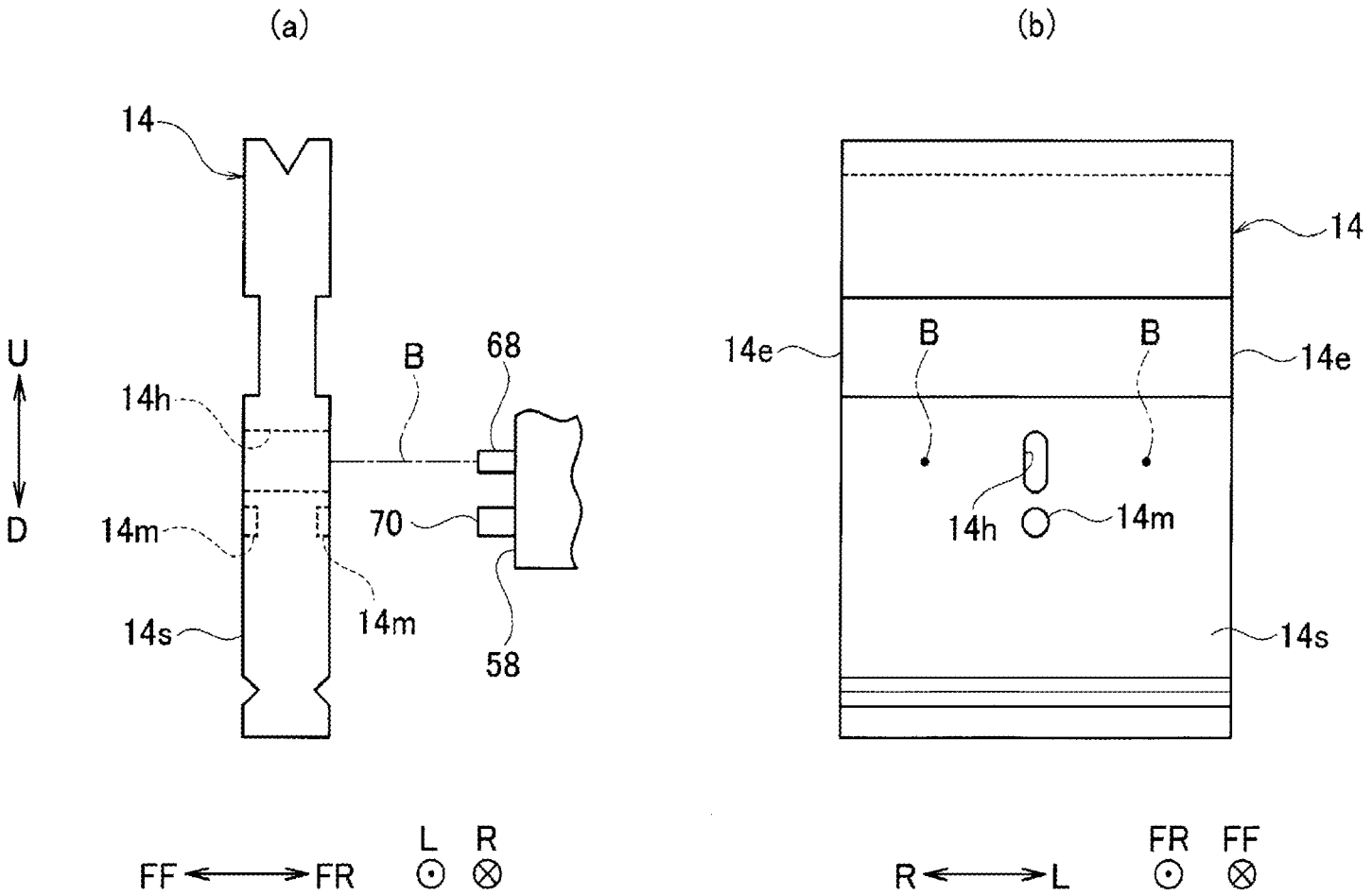
FIG. 4(*a*) is a schematic diagram showing that an engagement hole of a die tool is being detected, and that identification information about the die tool is being read in the first embodiment.

Here, as shown in FIG. 4, in the center of each die tool 14 in the left-right direction (the lateral direction), an engagement hole 14*h* as a part of the die tool 14 is penetratingly formed. At positions corresponding to the engagement hole 14*h* (for example, on the lower side of the engagement hole 14*h*) on both faces (the front face and back face) of the die tool 14, identification marks 14*m* as storage media storing identification information about the die tool 14 are provided by engraving, and each identification mark 14*m* is configured with a two-dimensional code. The identification information about the die tool 14 corresponds to tool information about the die tool 14, and the tool information about the die tool 14 includes a type, shape, width dimension in the left-right direction and height dimension of the die tool 14, a relative position of the center of the engagement hole 14*h* in the die tool 14 and the like. The width dimension of the die tool 14 in the left-right direction is assumed to include a dimension from an end face 14*e* of the die tool 14 to the center of the die tool 14 in the left-right direction. The relative position of the center of the engagement hole 14*h* in the die tool 14 is assumed to include a dimension from the end face 14*e* of the die tool 14 to the center of the engagement hole 14*h* in the left-right direction and an amount of deviation of the center of the engagement hole 14*h* relative to the center of the die tool 14.

As shown in FIGS. 1 to 3, an upper tool holder 34 to removably retain the punch tools 12 is provided on the lower side of the upper table 26, and the upper tool holder 34 extends in the left-right direction. On the upper tool holder 34, a holder groove 34*g* into which shanks (bases) 12*s* of punch tools 12 are to be inserted is formed along the left-right direction, the holder groove 34*g* being in a publicly known configuration as shown in Patent Literatures 2 and 3. The upper tool holder 34 has a hydraulic clamp plate 36 to fix the punch tools 12 to the upper table 26.

Figure 5:
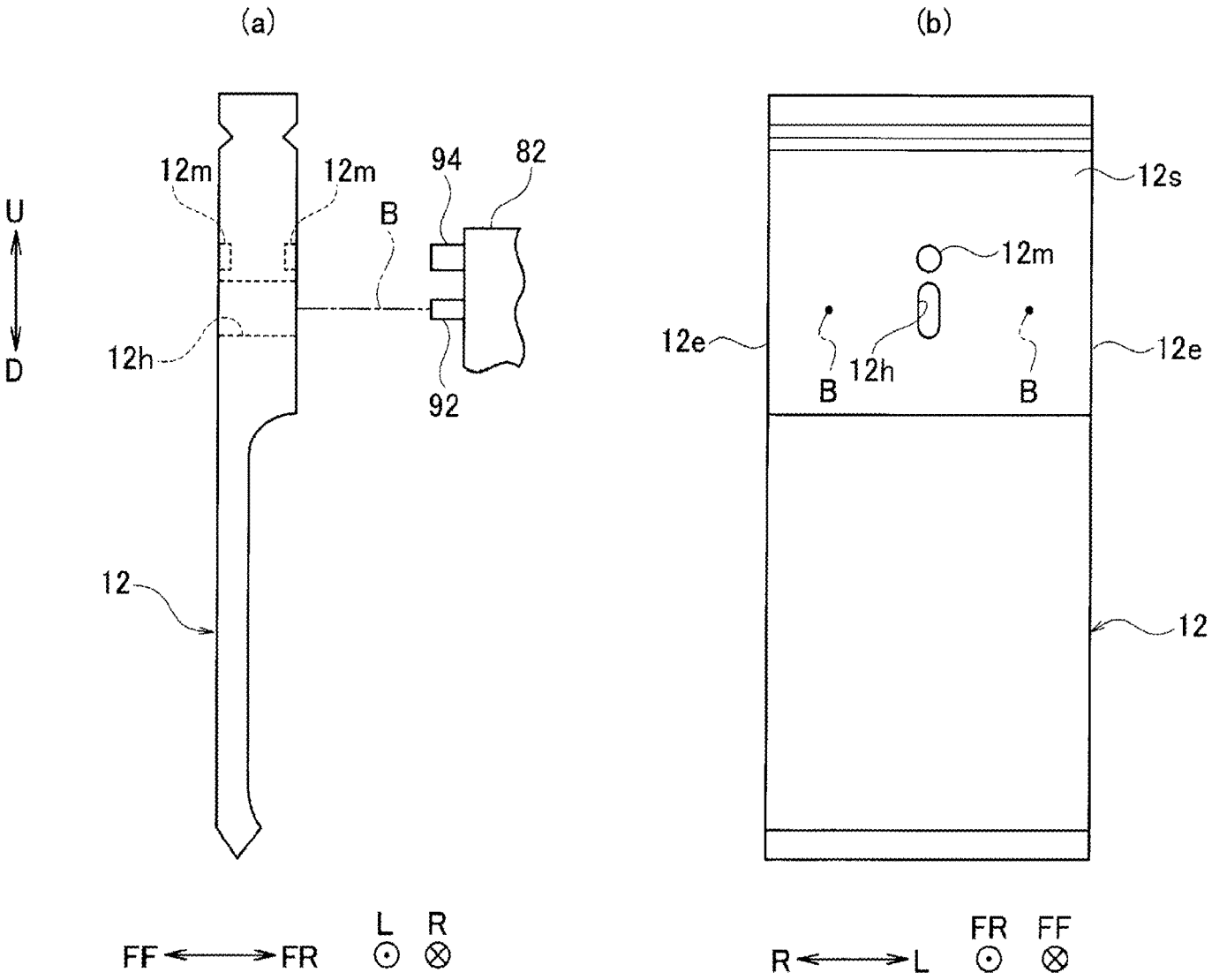
FIG. 5(*a*) is a schematic diagram showing that an engagement hole of a punch tool is being detected, and that identification information about the punch tool is being read in the first embodiment.

Here, as shown in FIG. 5, in the center of each punch tool 12 in the left-right direction, an engagement hole 12*h* as a part of the punch tool 12 is penetratingly formed. At positions corresponding to the engagement hole 12*h* (for example, on the upper side of the engagement hole 12*h*) on both faces of the punch tool 12, identification marks 12*m* as storage media storing identification information about the punch tool 12 are provided by engraving, and each identification mark 12*m* is configured with a two-dimensional code. The identification information about the punch tool 12 corresponds to tool information about the punch tool 12, and the tool information about the punch tool 12 includes a type, shape, width dimension in the left-right direction and height dimension of the punch tool 12, a relative position of the center of the engagement hole 12*h* in the punch tool 12 and the like. The width dimension of the punch tool 12 in the left-right direction is assumed to include a dimension from an end face 12*e* of the punch tool 12 to the center in the left-right direction. The relative position of the center of the engagement hole 12*h* in the punch tool 12 is assumed to include a dimension from the end face 12*e* of the punch tool 12 to the center of the engagement hole 12*h* in the left-right direction and an amount of deviation of the center of the engagement hole 12*h* relative to the center of the punch tool 12.

As shown in FIG. 1, on one side (the right side) of the lower tool holder 30 in the left-right direction, a lower joint block 38 extending in the left-right direction is provided. On the lower joint block 38, a joint groove (not shown) into which the shank 14*s* of a die tool 14 is to be inserted is formed along the left-right direction. The joint groove of the lower joint block 38 is connected to the holder groove 30*g* (see FIG. 3) of the lower tool holder 30. Further, on one side of the upper tool holder 34 in the left-right direction, an upper joint block 40 extending in the left-right direction is provided. On the upper joint block 40, a joint groove (not shown) into which the shank 12*s* of a punch tool 12 are to be inserted is formed along the left-right direction. The joint groove of the upper joint block 40 is connected to the holder groove 34*g* (see FIG. 3) of the upper tool holder 34.

As shown in FIGS. 1 and 2, the bending system 10 includes a tool rack 42 arranged on the side (the right side) of the press brake in the left-right direction and storing a plurality of die tools 14 and a plurality of punch tools 12. The tool rack 42 is, for example, in a publicly known configuration as shown in Patent Literatures 1 and 4. The configuration of the tool rack 42 will be simply explained.

The tool rack 42 has a plurality of lower stockers 44 for retaining one or more die tools 14, and the plurality of lower stockers 44 are arranged in the front-back direction. Each lower stocker 44 extends in the left-right direction, and, on each lower stocker 44, a stocker groove 44*g* into which the shanks 14*s* of die tools 14 are to be inserted is formed along the left-right direction.

A configuration is made so that a selected arbitrary lower stocker 44 is movable in the front-back direction by such a lower stocker movement mechanism (not shown) as shown in Patent Literature 1. Alternatively, the plurality of lower stockers 44 are configured to be synchronously movable in the front-back direction by such a lower stocker movement mechanism (not shown) as shown in Patent Literature 4. A configuration is made so that the selected arbitrary lower stocker 44 is positioned at a lower tool exchange position contiguous to the lower joint block 38 in the left-right direction, by its movement in the front-back direction. When the arbitrary lower stocker 44 is positioned at the lower tool exchange position, the stocker groove 44*g* of the lower stocker 44 is connected to the joint groove of the lower joint block 38.

The tool rack 42 has a plurality of upper stockers 46 for retaining one or more punch tools 12, and the plurality of upper stockers 46 are arranged along the front-back direction. Each upper stocker 46 extends in the left-right direction, and, on each upper stocker 46, a stocker groove 46*g* into which the shanks 12*s* of punch tools 12 are to be inserted is formed along the left-right direction.

A configuration is made so that a selected arbitrary upper stocker 46 is movable in the front-back direction by such an upper stocker movement mechanism (not shown) as shown in Patent Literature 1. Alternatively, the plurality of upper stockers 46 are configured to be synchronously movable in the front-back direction by such an upper stocker movement mechanism (not shown) as shown in Patent Literature 4. A configuration is made so that the selected arbitrary upper stocker 46 is positioned at an upper tool exchange position contiguous to the upper joint block 40 in the left-right direction, by its movement in the front-back direction. When the arbitrary upper stocker 46 is positioned at the upper tool exchange position, the stocker groove 46*g* of the upper stocker 46 is connected to the joint groove of the upper joint block 40.

As shown in FIGS. 1 to 3, a lower guide 48 extending in the left-right direction is provided on the back side (the rear side) of the lower tool holder 30, and the lower guide 48 projects to the right of the lower joint block 38. On the back side of the lower table 24, a pair of lower tool exchange units 50 as lower moving bodies are provided being movable in the left-right direction via the lower guide 48. The lower tool exchange units 50 transport die tools 14 between the lower tool holder 30 and a lower stocker 44 positioned at the lower tool exchange position. Each lower tool exchange unit 50 moves in the left-right direction relative to the lower table 24 by driving of a servo motor 52 as a left-right moving actuator provided at an appropriate position on the lower tool exchange unit 50. The servo motor 52 has an encoder 54 as a position detector to detect a position of the lower tool exchange unit 50 in the left-right direction.

Each lower tool exchange unit 50 is in a publicly known configuration as shown in Patent Literatures 2 and 3, and has a lower unit body 56 provided on the lower guide 48 being movable in the left-right direction and a lower support member 58 provided on the lower unit body 56 being movable in the front-back direction and in the vertical direction. The lower support member 58 moves in the front-back direction relative to the lower unit body 56 by driving of an air cylinder 60 as a front-back moving actuator provided at an appropriate position on the lower unit body 56. The lower support member 58 moves in the vertical direction relative to the lower unit body 56 by driving of an air cylinder 62 as a vertically moving actuator provided at an appropriate position on the lower unit body 56.

Each lower tool exchange unit 50 has a lower tool retention member (a lower hook member) 64 provided on the lower support member 58 being movable in the front-back direction, and the lower tool retention member 64 is engageable with and disengageable from the engagement hole 14*h* of a die tool 14. The lower tool retention member 64 moves in the front-back direction relative to the lower support member 58 by driving of an air cylinder 66 as another front-back moving actuator provided at an appropriate position on the lower support member 58.

Since an operation of retaining a die tool 14 by the lower tool retention member 64 is commonly known as shown in Patent Literatures 2 and 3, details thereof will be omitted.

As shown in FIGS. 3 and 4, at an appropriate position on each lower support member 58, a photoelectric sensor 68 is provided as a hole detector to detect the engagement hole 14*h* of a die tool 14 fitted to the lower tool holder 30. The photoelectric sensor 68 is configured to emit an inspection beam B and detect the engagement hole 14*h* of the die tool 14 from a result of receiving a reflected beam of the inspection beam B, in a state of being located at the same height as the engagement hole 14*h* of the die tool 14.

On the lower side of the photoelectric sensor 68 on each lower support member 58, a two-dimensional code reader 70 as an information reader is provided, and the two-dimensional code reader 70 reads tool identification information about a die tool 14 from an identification mark 14*m* in a state of being located at the same height as the identification mark 14*m*. In other words, on the lower side of the photoelectric sensor 68 on the lower support member 58, the two-dimensional code reader 70 to read tool information about the die tool 14 via the tool identification information about the die tool 14 is provided.

The photoelectric sensor 68 and the two-dimensional code reader 70 may be provided on the lower unit body 56 instead of being provided on the lower support member 58.

As shown in FIGS. 1 to 3, an upper guide 72 extending in the left-right direction is provided on the back side of the upper tool holder 34, and the upper guide 72 projects to the right of the upper joint block 40. On the back side of the upper table 26, a pair of upper tool exchange units 74 as upper moving bodies are provided being movable in the left-right direction via the upper guide 72. The upper tool exchange units 74 transport punch tools 12 between the upper tool holder 34 and an upper stocker 46 positioned at the upper tool exchange position. Each upper tool exchange unit 74 moves in the left-right direction relative to the upper table 26 by driving of a servo motor 76 as a left-right moving actuator provided at an appropriate position on the upper tool exchange unit 74. The servo motor 76 has an encoder 78 as a position detector to detect a position of the upper tool exchange unit 74 in the left-right direction.

Each upper tool exchange unit 74 is in a publicly known configuration as shown in Patent Literatures 2 and 3, and has an upper unit body 80 provided on the upper guide 72 being movable in the left-right direction and an upper support member 82 provided on the upper unit body 80 being movable in the front-back direction and in the vertical direction. The upper support member 82 moves in the front-back direction relative to the upper unit body 80 by driving of an air cylinder 84 as a front-back moving actuator provided at an appropriate position on the upper unit body 80. The upper support member 82 moves in the vertical direction relative to the upper unit body 80 by driving of an air cylinder 86 as a vertically moving actuator provided at an appropriate position on the upper unit body 80.

Each upper tool exchange unit 74 has an upper tool retention member (an upper hook member) 88 provided on the upper support member 82 being movable in the front-back direction, and the upper tool retention member 88 is engageable with and disengageable from the engagement hole 12*h* of a punch tool 12. The upper tool retention member 88 moves in the front-back direction relative to the upper support member 82 by driving of an air cylinder 90 as another front-back moving actuator provided at an appropriate position on the upper support member 82.

Since an operation of retaining a punch tool 12 by the upper tool retention member 88 is commonly known as shown in Patent Literatures 2 and 3, details thereof will be omitted.

As shown in FIGS. 3 and 5, at an appropriate position on each upper support member 82, a photoelectric sensor 92 is provided as a hole detector to detect the engagement hole 12*h* of a punch tool 12 fitted to the upper tool holder 34. The photoelectric sensor 92 is configured to emit an inspection beam B and detect the engagement hole 12*h* of the punch tool 12 from a result of receiving a reflected beam of the inspection beam B, in a state of being located at the same height as the engagement hole 12*h* of the punch tool 12.

On the upper side of the photoelectric sensor 92 on each upper support member 82, a two-dimensional code reader 94 as an information reader is provided, and the two-dimensional code reader 94 reads identification information about a punch tool 12 from an identification mark 12*m* in a state of being located at the same height as the identification mark 12*m*. In other words, on the upper side of the photoelectric sensor 92 on the upper support member 82, the two-dimensional code reader 94 to read tool information about the punch tool 12 via the identification information about the punch tool 12 is provided.

The photoelectric sensor 92 and the two-dimensional code reader 94 may be provided on the upper unit body 80 instead of being provided on the upper support member 82.

Figure 6:
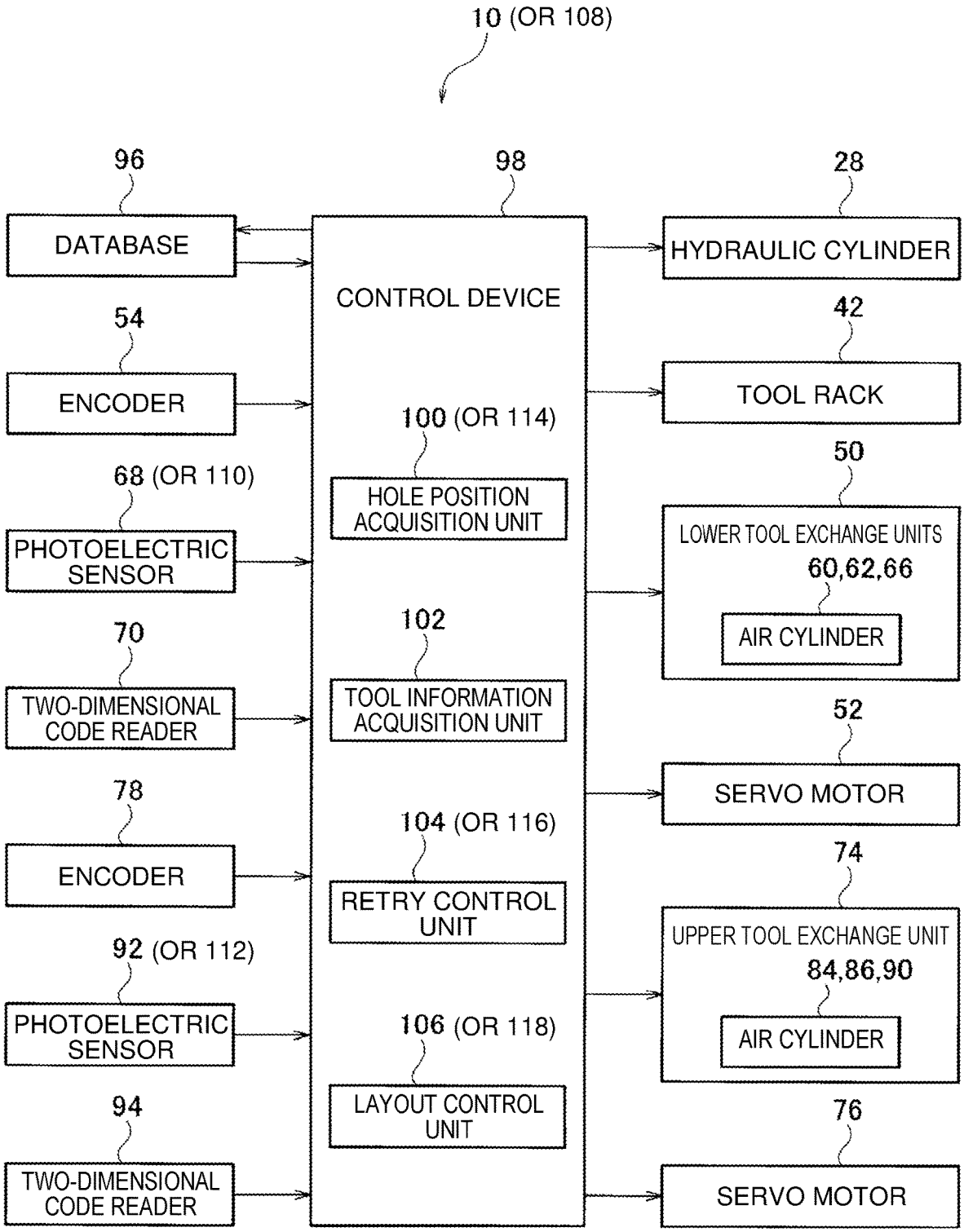
FIG. 6 is a control block diagram of the bending system according to the first and second embodiments.

As shown in FIGS. 1 and 6, the bending system 10 includes a database 96 storing tool information about the plurality of die tools 14 and tool information about the plurality of punch tools 12. The tool information about the plurality of die tools 14 is associated with identification information about the plurality of die tools 14 in the database 96. The tool information about the plurality of punch tools 12 is associated with identification information about the plurality of punch tools 12 in the database 96.

The bending system 10 includes a control device 98 to control the hydraulic cylinders 28 and the like based on a processing program and controls the lower tool exchange units 50 and the like based on a tool exchange program. The control device 98 is configured with a computer, and the encoders 54, the photoelectric sensors 68, the two-dimensional code readers 70, the encoders 78, the photoelectric sensors 92, the two-dimensional code readers 94, the database 96 and the like are connected to the control device 98. The control device 98 has a memory (not shown) storing the processing program, the tool exchange program and the like, and a CPU (not shown) that executes the processing program and the tool exchange program.

The processing program and the tool exchange program include layout information showing a layout state of die tools 14 and layout information showing a layout state of die tools 14 on each lower stocker 44. The processing program and the tool exchange program include layout information showing a layout state of the punch tools 12 and layout information showing a layout state of the punch tools 12 on each upper stocker 46.

By executing the tool exchange program, the CPU of the control device 98 demonstrates functions as a hole position acquisition unit 100, a tool information acquisition unit 102, a retry control unit 104 and a layout control unit 106. Specific content of functions of the hole position acquisition unit 100, the tool information acquisition unit 102, the retry control unit 104 and the layout control unit 106 are as below.

As shown in FIGS. 4 to 6, based on positions of the lower tool exchange units 50 in the left-right direction at the time of engagement holes 14*h* of die tools 14 being detected by the photoelectric sensors 68, the hole position acquisition unit 100 acquires positions of centers of the engagement holes 14*h* of the die tools 14 in the left-right direction by calculation. The hole position acquisition unit 100 acquires the positions of the centers of the engagement holes 14*h* of the die tools 14 in the left-right direction in consideration of relative positions of the photoelectric sensors 68 relative to the lower unit bodies 56. Similarly, based on positions of the upper tool exchange units 74 in the left-right direction at the time of engagement holes 12*h* of punch tools 12 being detected by the photoelectric sensors 92, the hole position acquisition unit 100 acquires positions of centers of the engagement holes 12*h* of the punch tools 12 in the left-right direction by calculation. The hole position acquisition unit 100 acquires the positions of the centers of the engagement holes 12*h* of the punch tools 12 in the left-right direction in consideration of a relative positions of the photoelectric sensors 92 relative to the upper unit bodies 80.

Referring to the database 96, the tool information acquisition unit 102 acquires tool information about the die tools 14, including width dimensions of the die tools 14 in the left-right direction and relative positions of the centers of the engagement holes 14*h*, based on identification information about the die tools 14 from the two-dimensional code readers 70. Similarly, referring to the database 96, the tool information acquisition unit 102 acquires tool information about the punch tools. 12, including width dimensions of the punch tools 12 in the left-right direction and relative positions of the centers of the engagement holes 12*h*, based on identification information about the punch tools 12 from the two-dimensional code readers 94.

As shown in FIGS. 3, 4, 6, 7A and 7B, if the operation of retaining a die tool 14 by one of the lower tool retention members 64 fails (see 7(*a*)), the retry control unit 104 executes a retry process of the lower tool exchange unit 50 and the like as below. Here, the failure in the operation of retaining the die tool 14 by the lower tool retention member 64 is judged by the fact that the air cylinder 60 or 66 has not reached a stroke end. If the operation of retaining the die tool 14 by the lower tool retention member 64 fails, an alarm occurs.

Figure 7A:
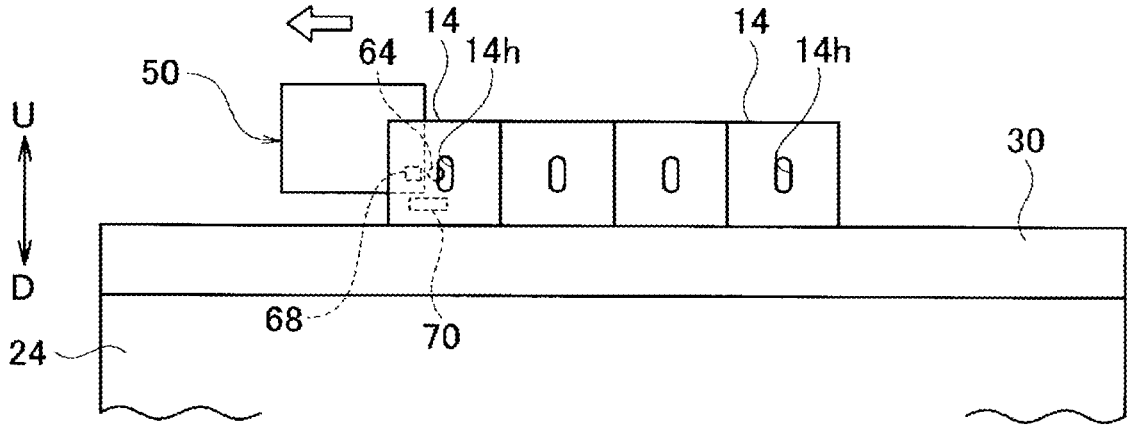
FIGS. 7A(a) and 7A(b) are schematic diagrams illustrating a retry process of a lower tool exchange unit and the like according to the first embodiment.
Figure 7A:
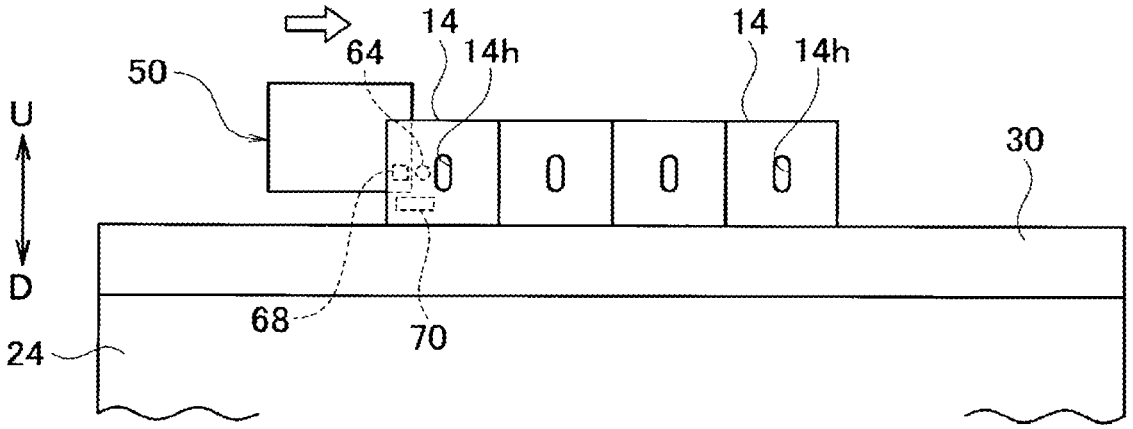
Figure 7A:
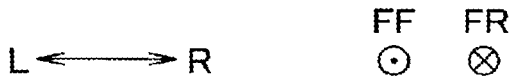

The retry control unit 104 controls the servo motor 52 so that the lower tool exchange unit 50 moves in the left-right direction (for example, in the left direction) relative to the lower table 24 by an amount corresponding to a relative position of the engagement hole 14*h* of the die tool 14, which is tool information about the die tool 14 acquired immediately after the alarm occurs (see FIG. 7A(a)). Next, the retry control unit 104 controls the servo motor 52 so that the lower tool exchange unit 50 moves in the left-right direction (for example, in the right direction) relative to the lower table 24 near a position where the alarm occurred (see FIGS. 7A(b) and 7B(a)). After that, based on a position of the center of the engagement hole 14*h* of the die tool 14 in the left-right direction acquired during movement of the lower tool exchange unit 50, the retry control unit 104 controls the lower tool exchange unit 50 to retry the operation of retaining the die tool 14 by the lower tool retention member 64 (see FIG. 7B(b)).

If the operation of retaining a punch tool 12 by one of the upper tool retention members 88 fails, the retry control unit 104 also executes the retry process of the upper tool exchange unit 74 and the like similarly to the above.

As shown in FIGS. 3, 4, 6, 8A and 8B, if the clamper 32 is accidentally released after a plurality of die tools 14 are fitted to the lower tool holder 30, the layout control unit 106 executes a layout process of the lower tool exchange units 50 and the like as below. Similarly, if a plurality of die tools 14 are randomly fitted to the lower tool holder 30 by manual work of a worker, the layout control unit 106 also executes the layout process of the lower tool exchange units 50 and the like as necessary.

Figure 8A:
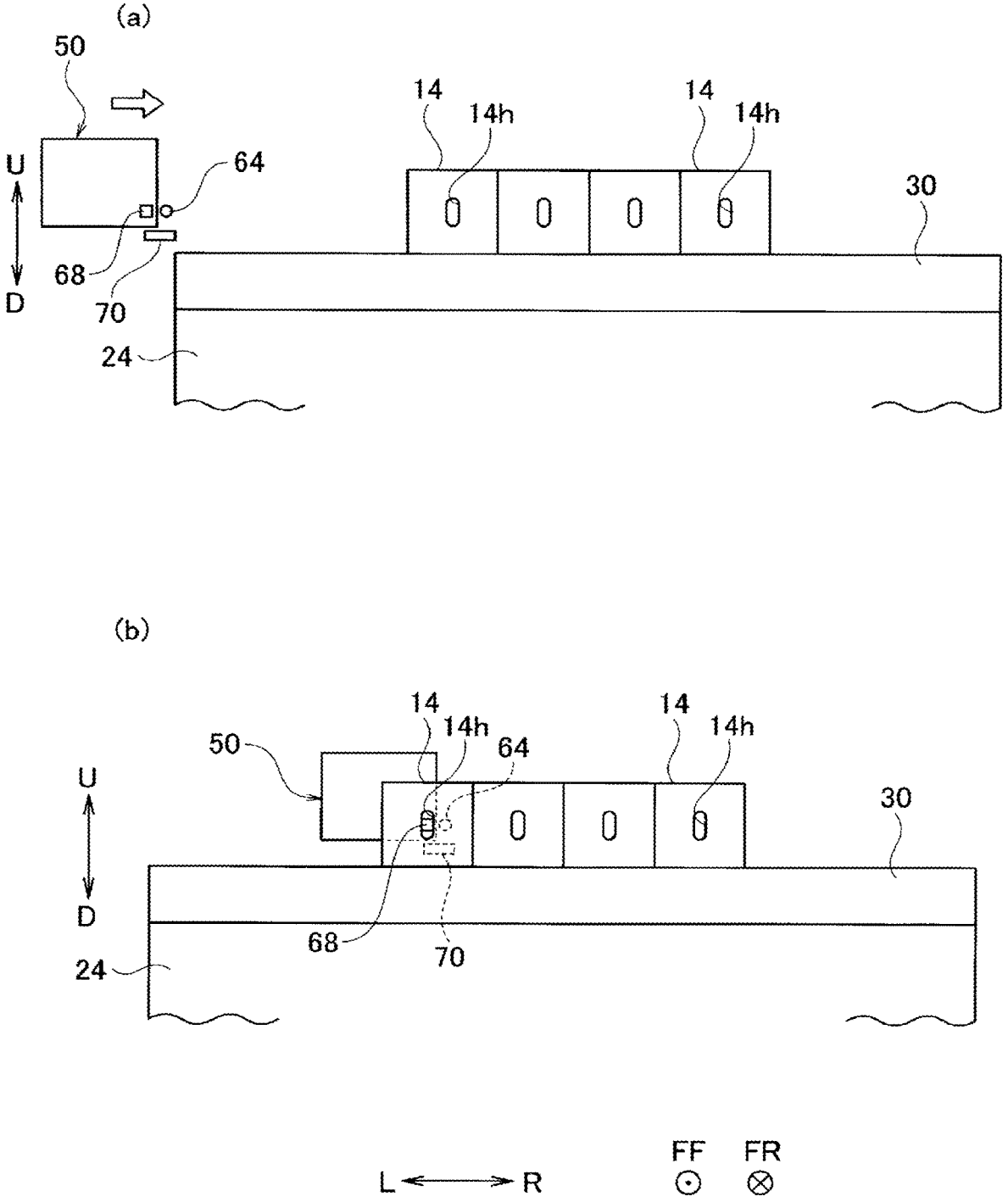
Figure 8B:
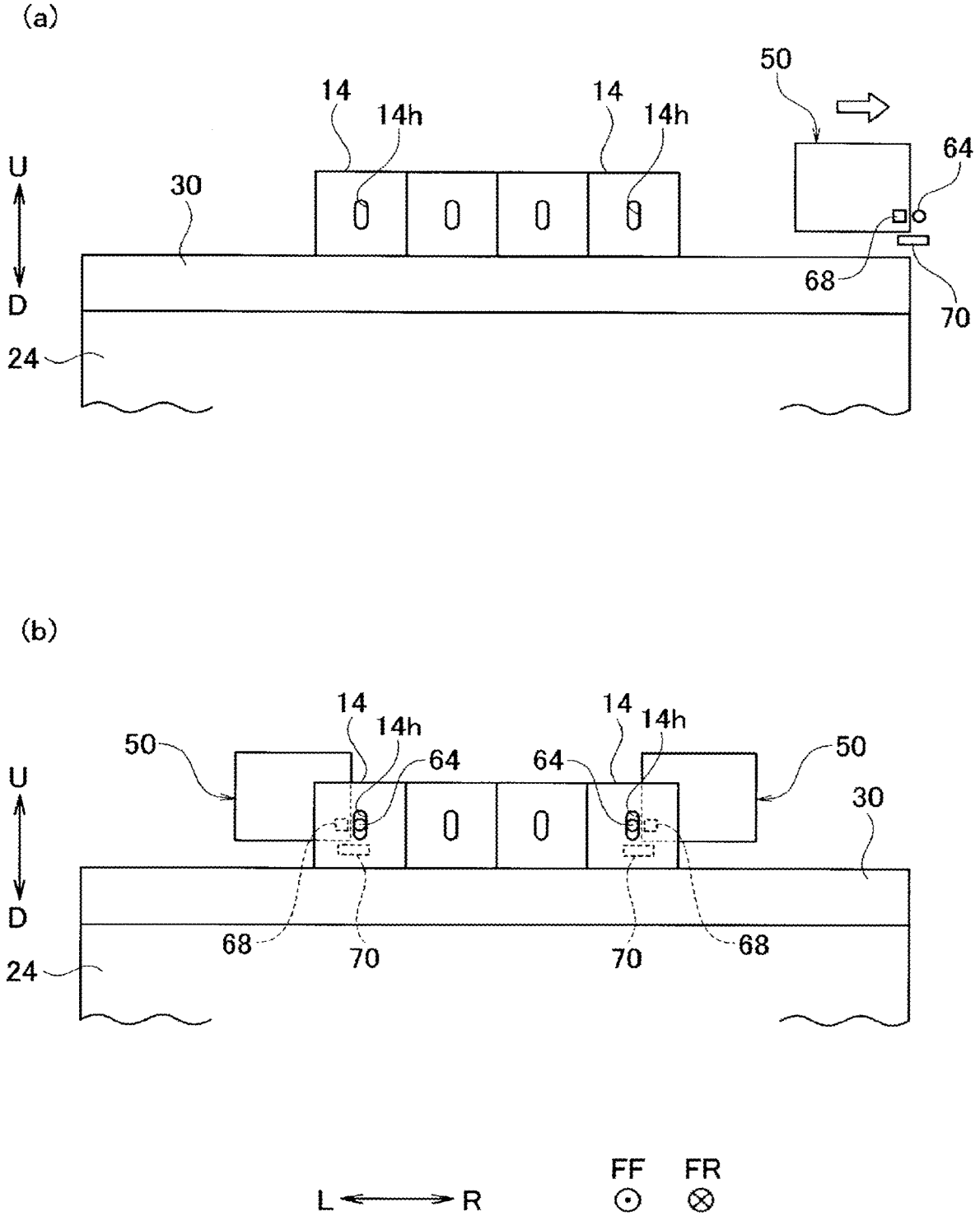

The layout control unit 106 controls the servo motors 52 so that the lower tool exchange units 50 move in the left-right direction (for example, in the right direction) relative to the lower table 24 from the side of the lower table 24 (see FIGS. 8A(a) and 8A(b) and FIG. 8B(a)). After that, based on acquired positions of the centers of the engagement holes 14*h* of the plurality of die tools 14 in the left-right direction and tool layout information about the plurality of die tools 14, the layout control unit 106 controls the lower tool exchange units 50 to lay out again the plurality of die tools 14 at regular arrangement positions on the lower tool holder 30 (see FIG. 8B(b)). Alternatively, based on the positions of the centers of the engagement holes 14*h* of the plurality of die tools 14 in the left-right direction and tool layout information about the plurality of die tools 14 on a lower stocker 44, the layout control unit 106 controls the lower tool exchange units 50 to remove the plurality of die tools 14 from the lower tool holder 30 and lay out them at regular arrangement positions on the lower stocker 44 as necessary.

The operation of laying out die tools 14 by the lower tool exchange units 50 is commonly known as shown in Patent Literatures 2 and 3, details thereof will be omitted.

If the clamp plate 36 is accidentally released after a plurality of punch tools 12 are fitted to the upper tool holder 34, the layout control unit 106 also executes a layout process of the upper tool exchange units 74 and the like similarly to the above.

Next, operation and effects of the first embodiment will be explained.

In the case of transporting die tools 14 from the lower tool holder 30 to a lower stocker 44 positioned at the lower tool exchange position, the control device 98 controls the servo motor 52 to cause the lower tool exchange units 50 to move in the left-right direction and causes the lower tool retention members 64 to face the engagement holes 14*h* of the die tools 14 fitted to the lower tool holder 30. Then, while causing the lower tool retention members 64 to be engaged with the engagement holes 14*h* of the die tools 14, the control device 98 causes the lower tool retention members 64 to retain the die tools 14. Furthermore, the control device 98 controls the lower tool exchange units 50 to remove the die tools 14 from the lower tool holder 30. The die tools 14 may be removed from the lower tool holder 30 by being caused to slide in the right direction on the lower tool holder 30.

Next, the control device 98 controls the servo motors 52 to cause the lower tool exchange units 50 to move in the right direction and cause the lower tool retention members 64 to be located at positions corresponding to the lower stocker 44 positioned at the lower tool exchange position. Then, the control device 98 controls the lower tool exchange units 50 to fit the die tools 14 to the lower stocker 44. After that, the control device 98 causes the lower tool retention members 64 to be disengaged from the engagement holes 14*h* of the die tools 14 and releases the state of retaining the die tools 14 by the lower tool retention members 64. The die tool 14 may be fitted to the lower stocker 44 by being caused to slide in the right direction on the lower joint block 38.

In the case of transporting die tools 14 from a lower stocker 44 positioned at the lower tool exchange position to the lower tool holder 30, an operation opposite to the operation described above is performed. Thereby, it is possible to perform automatic exchange of die tools 14 fitted to the lower tool holder 30 with die tools 14 fitted to the lower stocker 44.

In the case of transporting punch tools 12 between the upper tool holder 34 and an upper stocker 46 positioned at the upper tool exchange position, an operation similar to the above is also performed. Thereby, it is possible to perform automatic exchange of punch tools 12 fitted to the upper tool holder 34 with punch tools 12 fitted to an upper stocker 46.

If the operation of retaining a die tool 14 by one of the lower tool retention members 64 fails in the case of transporting die tools 14 from the lower tool holder 30 to a lower stocker 44 positioned at the lower tool exchange position (see FIG. 7A(a)), the following operation is performed.

Immediately after an alarm occurs, while referring to the database 96, the tool information acquisition unit 102 acquires tool information about the die tool 14 including a relative position of the engagement hole 14*h* of the die tool 14, based on identification information about the die tool 14 from the two-dimensional code reader 70. Then, the retry control unit 104 controls the servo motor 52 to cause the lower tool exchange unit 50 to move in the left-right direction (for example, in the left direction) relative to the lower table 24 by an amount corresponding to the relative position of the engagement hole 14*h* of the die tool 14 (see FIG. 7A(a)). The tool information acquisition unit 102 may acquire tool information about the die tool 14 based on a detection result from the encoder 54 at the time of the occurrence of the alarm and layout information about the die tool 14.

Next, the retry control unit 104 controls the servo motor 52 to cause the lower tool exchange unit 50 to move in the left-right direction near the alarm occurrence position while monitoring detection results from the encoder 54 (see FIG. 7A(b)). Further, during the movement of the lower tool exchange unit 50, the photoelectric sensor 68 emits an inspection beam B and detects the engagement hole 14*h* of the die tool 14 from a result of receiving a reflected beam of the inspection beam B (see FIG. 7B(a)). Then, based on a position of the lower tool exchange unit 50 in the left-right direction at the time of the engagement hole 14*h* of the die tool 14 being detected and the like, the hole position acquisition unit 100 acquires a position of the center of the engagement hole 14*h* of the die tool 14 in the left-right direction.

Figure 7B:
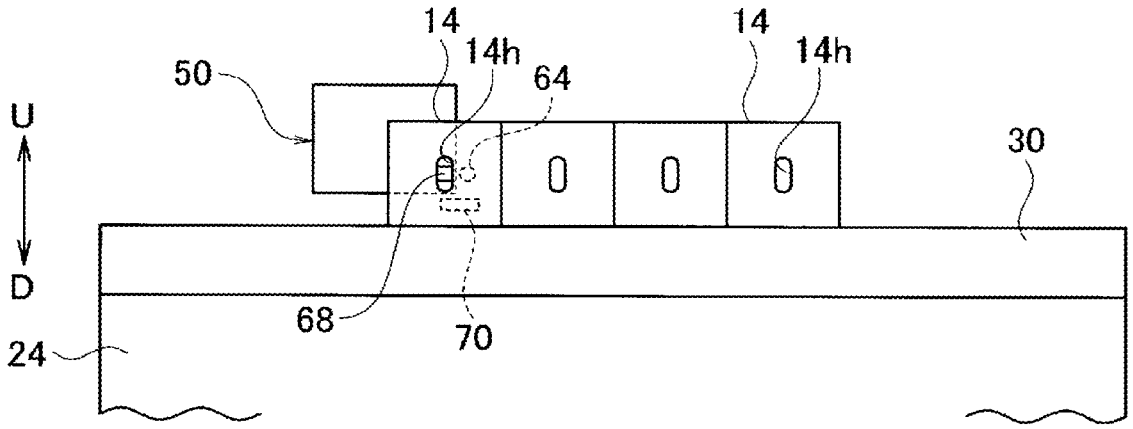
FIGS. 7B(a) and 7B(b) are schematic diagrams illustrating a retry process of the lower tool exchange unit and the like according to the first embodiment.
Figure 7B:
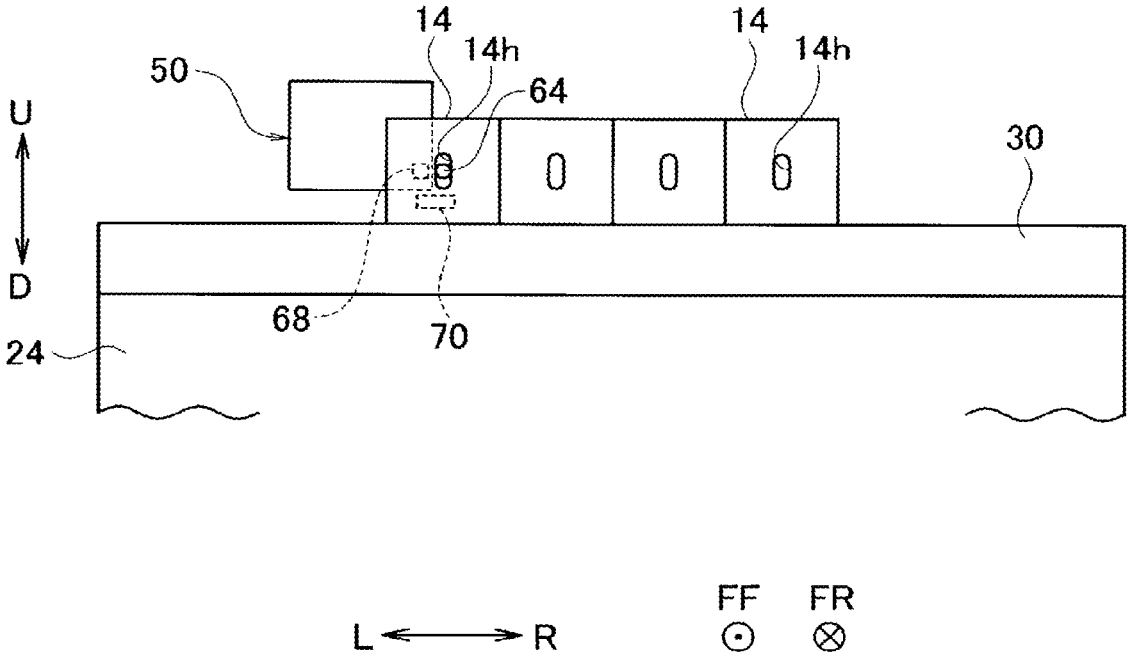

After that, based on the acquired position of the center of the engagement hole 14*h* of the die tool 14 in the left-right direction, the retry control unit 104 controls the lower tool exchange unit 50 to retry the operation of retaining the die tool 14 by the lower tool retention member 64 (see FIG. 7B (b)). Thereby, it is possible to continue the operation related to the transportation of the die tools 14 by the lower tool exchange units 50.

If the operation of retaining a punch tool 12 by one of the upper tool retention members 88 fails in the case of transporting punch tools 12 from the upper tool holder 34 to an upper stocker 46 positioned at the upper tool exchange position, an operation similar to the above is also performed. Thereby, it is possible to continue the operation related to the transportation of the punch tools 12 by the upper tool exchange units 74.

In a case where the clamper 32 is accidentally released after a plurality of die tools 14 are fitted to the lower tool holder 30, a case where a plurality of die tools 14 are randomly fitted to the lower tool holder 30, or the like, the following operation is performed.

The layout control unit 106 controls the servo motors 52 to cause the lower tool exchange units 50 to move in the left-right direction (for example, in the right direction) relative to the lower table 24 from the side of the lower table 24 while monitoring detection results from the encoders 54 (see FIGS. 8A(a) and 8A(b) and FIG. 8B(a)). During the movements of the lower tool exchange units 50, the photoelectric sensors 68 emit inspection beams B and detect the engagement holes 14*h* of the plurality of die tools 14 from results of receiving reflected beams of the inspection beams B. Then, based on positions of the lower tool exchange units 50 in the left-right direction at the time of the engagement holes 14*h* of the plurality of die tools 14 being detected and the like, the hole position acquisition unit 100 acquires positions of the centers of the engagement holes 14*h* of the plurality of die tools 14 in the left-right direction (see FIG. 8A(b)). Thereby, the bending system 10 can recognize an actual layout state of the plurality of die tools 14 on the lower tool holder 30. During the movements of the lower tool exchange units 50, the tool information acquisition unit 102 may acquire tool information about the plurality of die tools 14.

After that, based on the acquired positions of the centers of the engagement holes 14*h* of the plurality of die tools 14 in the left-right direction and tool layout information about the plurality of die tools 14, the layout control unit 106 controls the lower tool exchange units 50 to lay out again the plurality of die tools 14 at regular arrangement positions on the lower tool holder 30 (see FIG. 8B(b)). Alternatively, based on the acquired positions of the centers of the engagement holes 14*h* of the plurality of die tools 14 in the left-right direction and tool layout information about the plurality of die tools 14 on a lower stocker 44, the layout control unit 106 controls the lower tool exchange units 50 to remove the plurality of die tools 14 from the lower tool holder 30 and lay out them at regular arrangement positions on the lower stocker 44. Thereby, it is possible to continue the operation related to the transportation of the die tools 14 by the lower tool exchange units 50.

In a case where the clamp plate 36 is accidentally released after a plurality of punch tools 12 are fitted to the upper tool holder 34, a case where a plurality of punch tools 12 are randomly fitted to the upper tool holder 34, or the like, an operation similar to the above is also performed. Thereby, it is possible to continue the operation related to the transportation of the punch tools 12 by the upper tool exchange units 74.

If there are gaps among a plurality of die tools 14 during movement of the lower tool exchange units 50, the photoelectric sensors 68 detect the end faces 14*e* of die tools 14 on the middle side. The bending system 10 can determine whether there are gaps among the plurality of die tools 14, based on tool layout information about the plurality of die tools 14.

In short, according to the first embodiment, based on positions of the lower tool exchange units 50 in the left-right direction at the time of the engagement holes 14*h* of die tools 14 being detected by the photoelectric sensors 68, and the like, the hole position acquisition unit 100 acquires positions of the centers of the engagement holes 14*h* of the die tools 14 in the left-right direction by calculation, as mentioned above. Based on positions of the upper tool exchange units 74 in the left-right direction at the time of the engagement holes 12*h* of punch tools 12 being detected by the photoelectric sensors 92 and the like, the hole position acquisition unit 100 acquires positions of the centers of the engagement holes 12*h* of the punch tools 12 in the left-right direction. Further, the tool information acquisition unit 102 acquires tool information about die tools 14 based on identification information about the die tools 14 from the two-dimensional code readers 70. The tool information acquisition unit 102 acquires tool information about punch tools 12 based on identification information about the punch tools 12 from the two-dimensional code readers 94. Thereby, the bending system 10 can accurately recognize actual positions of the engagement holes 14*h* of a plurality of die tools 14 in the left-right direction on the lower tool holder 30 and actual positions of the engagement holes 12*h* of a plurality of punch tools 12 in the left-right direction on the upper tool holder 34.

Therefore, according to the first embodiment, it is possible to stabilize automatic operation of the bending system 10 without the operation related to transportation of die tools 14 by the lower tool exchange units 50 and the like being interrupted in the middle of the operation and the like.

Second Embodiment

As shown in FIG. 1, a bending system 108 according to a second embodiment has a configuration similar to that of the bending system 10 according to the first embodiment except for a part thereof. Among components of the bending system 108, components different from those of the bending system 10 will be explained. Among the plurality of components of the bending system 108, components corresponding to components of the bending system 10 are given the same reference signs in drawings.

Figure 9:
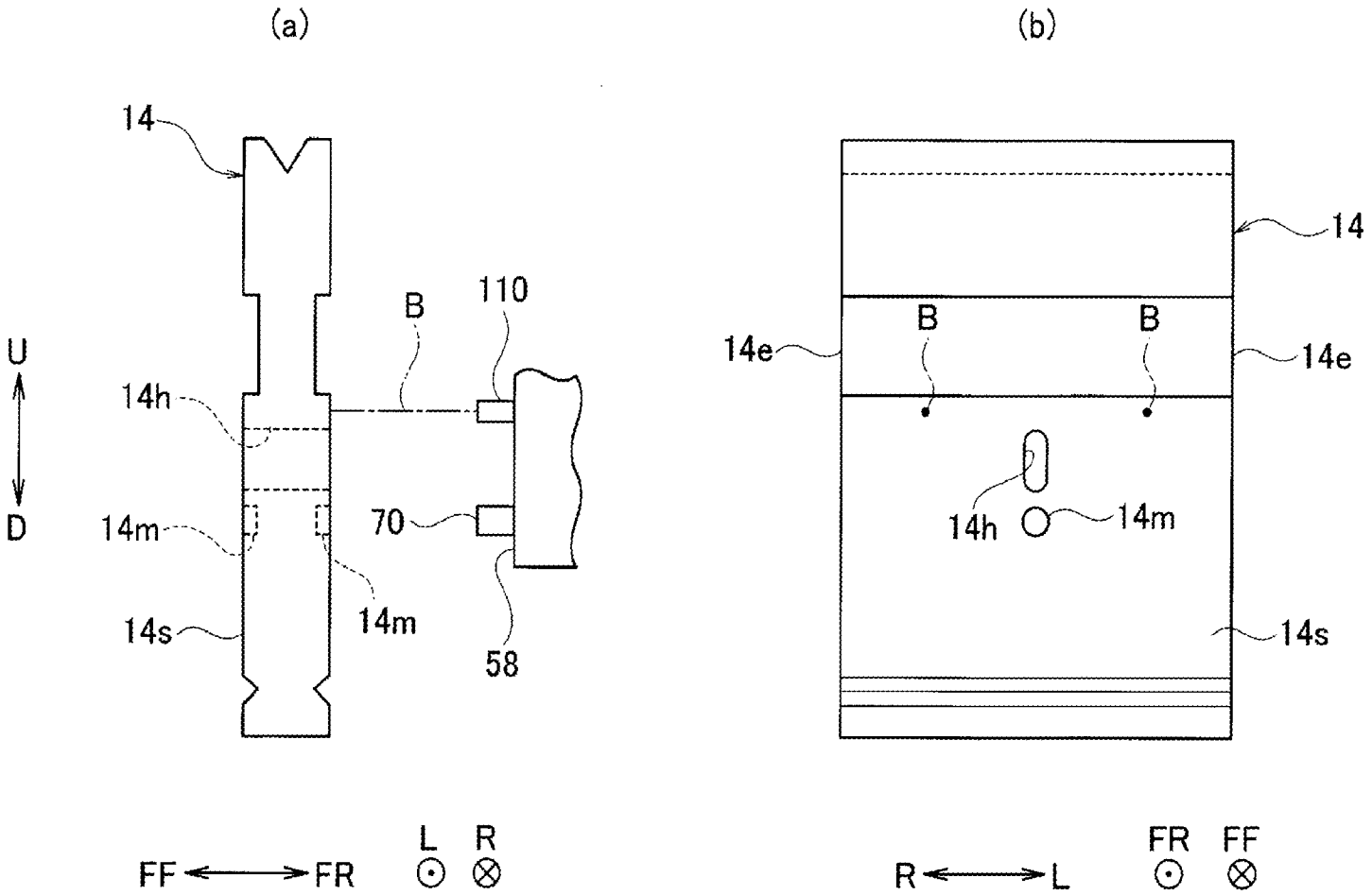
FIG. 9(*a*) is a schematic diagram showing that an end face of a die tool is being detected, and that identification information about the die tool is being read in a second embodiment.

As shown in FIGS. 6 and 9, at an appropriate position on each lower support member 58, a photoelectric sensor 110 is provided as an end face detector to detect the end face 14*e* of a die tool 14 fitted to the lower tool holder 30 instead of the photoelectric sensor 68 (see FIG. 4). The photoelectric sensor 110 is configured to emit an inspection beam B and detect the end face 14*e* of the die tool 14 from a result of receiving a reflected beam of the inspection beam B, in a state of being located at the same height as a part higher than the engagement hole 14*h* on the die tool 14.

The photoelectric sensor 110 may detect the end face 14*e* of the die tool 14 in a state of being located at the same height as the engagement hole 14*h* of the die tool 14. In this case, the control device 98 judges which of the end face 14*e* and engagement hole 14*h* of the die tool 14 the detection target of the photoelectric sensor 110 is, based on tool layout information and the like about a plurality of die tools 14.

Figure 10:
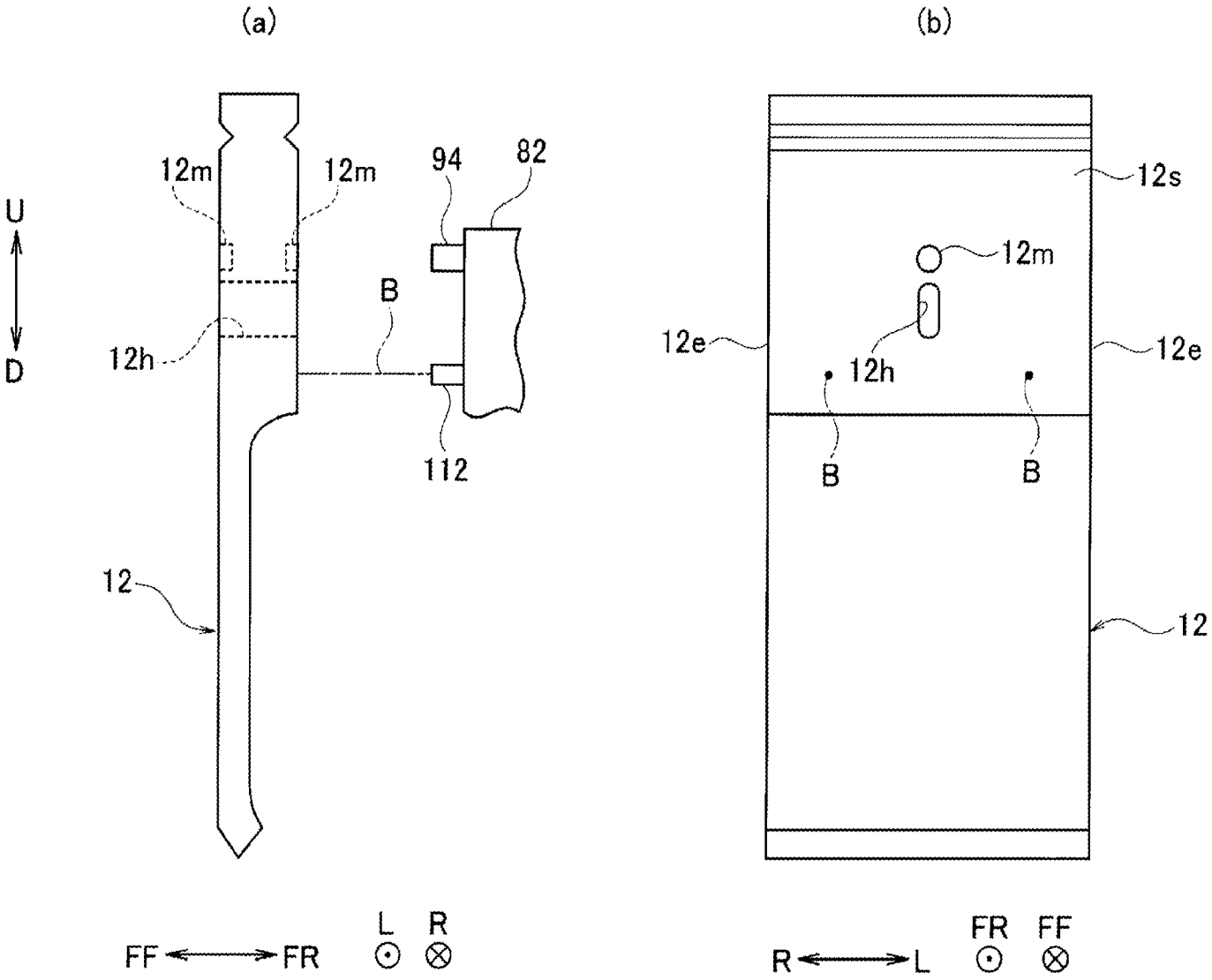
FIG. 10(*a*) is a schematic diagram showing that an end face of a punch tool is being detected, and that identification information about the punch tool is being read in the second embodiment.

As shown in FIG. 10, at an appropriate position on each upper support member 82, a photoelectric sensor 112 is provided as an end face detector to detect the end face 12*e* of a punch tool 12 fitted to the upper tool holder 34 instead of the photoelectric sensor 92 (see FIG. 5). The photoelectric sensor 112 is configured to emit an inspection beam B and detect the end face 12*e* of the punch tool 12 from a result of receiving a reflected beam of the inspection beam B, in a state of being located at the same height as a part lower than the engagement hole 12*h* on the punch tool 12.

The photoelectric sensor 112 may detect the end face 12*e* of the punch tool 12 in a state of being located at the same height as the engagement hole 12*h* of the punch tool 12. In this case, the control device 98 judges which of the end face 12*e* and engagement hole 12*h* of the punch tool 12 the detection target of the photoelectric sensor 110 is, based on tool layout information and the like about a plurality of punch tools 12.

As shown in FIG. 6, in the second embodiment, the control device 98 has a hole position acquisition unit 114, a retry control unit 116 and a layout control unit 118 instead of the hole position acquisition unit 100, the retry control unit 104 and the layout control unit 106. Specific content of functions of the hole position acquisition unit 114, the retry control unit 116 and the layout control unit 118 are as below.

As shown in FIGS. 6, 9 and 10, based on positions of the lower tool exchange units 50 in the left-right direction at the time of end faces 14*e* of die tools 14 being detected, and acquired tool information about the die tools 14 (relative positions of the engagement holes 14*h* of the die tools 14), the hole position acquisition unit 114 acquires positions of the centers of the engagement holes 14*h* of the die tools 14 in the left-right direction by calculation. The hole position acquisition unit 114 acquires the positions of the centers of the engagement holes 14*h* of the die tools 14 in the left-right direction in consideration of relative positions of the photoelectric sensors 110 relative to the lower unit bodies 56. Similarly, based on positions of the upper tool exchange units 74 in the left-right direction at the time of end faces 12*e* of punch tools 12 being detected, and acquired tool information about the punch tools 12 (relative positions of the engagement holes 12*h* of the punch tools 12), the hole position acquisition unit 114 acquires positions of the centers of the engagement holes 12*h* of the punch tools 12 in the left-right direction by calculation. The hole position acquisition unit 114 acquires the positions of the centers of the engagement holes 12*h* of the punch tools 12 in the left-right direction in consideration of relative positions of the photoelectric sensors 112 relative to the upper unit bodies 80.

As shown in FIGS. 3, 6, 9, 11A and 11B, if the operation of retaining a die tool 14 by one of the lower tool retention members 64 fails (see 11A(a)), the retry control unit 116 executes a retry process of the lower tool exchange unit 50 and the like as below.

Figure 11A:
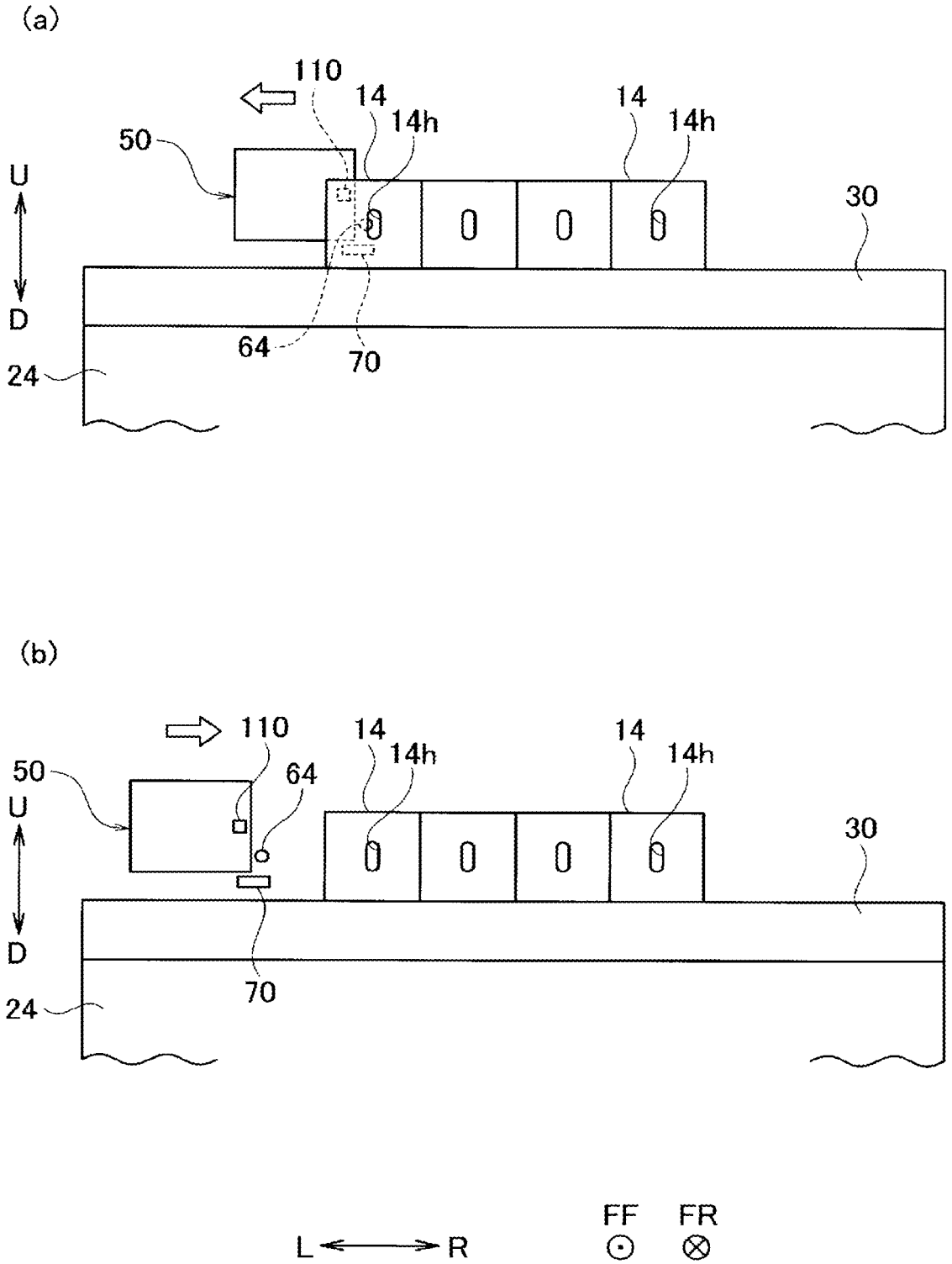
FIGS. 11A(a) and 11A(b) are schematic diagrams illustrating a retry process of a lower tool exchange unit and the like according to the second embodiment.

The retry control unit 116 controls the servo motor 52 so that the lower tool exchange unit 50 moves in the left-right direction (for example, in the left direction) relative to the lower table 24 by an amount corresponding to a relative position of the engagement hole 14*h* of the die tool 14, which is tool information about the die tool 14 acquired immediately after an alarm occurs (see FIG. 11A(a)). Next, the retry control unit 116 controls the servo motor 52 so that the lower tool exchange unit 50 moves in the left-right direction (for example, in the right direction) relative to the lower table 24 from the side of the die tool 14 (see FIGS. 11A(b) and 11B(a)). After that, based on an acquired position of the center of the engagement hole 14*h* of the die tool 14 in the left-right direction, the retry control unit 116 controls the lower tool exchange unit 50 to retry the operation of retaining the die tool 14 by the lower tool retention member 64 (see FIG. 11B (b)).

If the operation of retaining a punch tool 12 by one of the upper tool retention members 88 fails, the retry control unit 116 also executes the retry process of the upper tool exchange unit 74 and the like similarly to the above.

As shown in FIGS. 3, 6, 9, 12A and 12B, if the clamper 32 is accidentally released after a plurality of die tools 14 are fitted to the lower tool holder 30, the layout control unit 118 executes a layout process of the lower tool exchange units 50 and the like as below. Similarly, if a plurality of die tools 14 are randomly fitted to the lower tool holder 30 by manual work of a worker, the layout control unit 118 also executes the layout process of the lower tool exchange units 50 and the like as necessary.

Figure 12A:
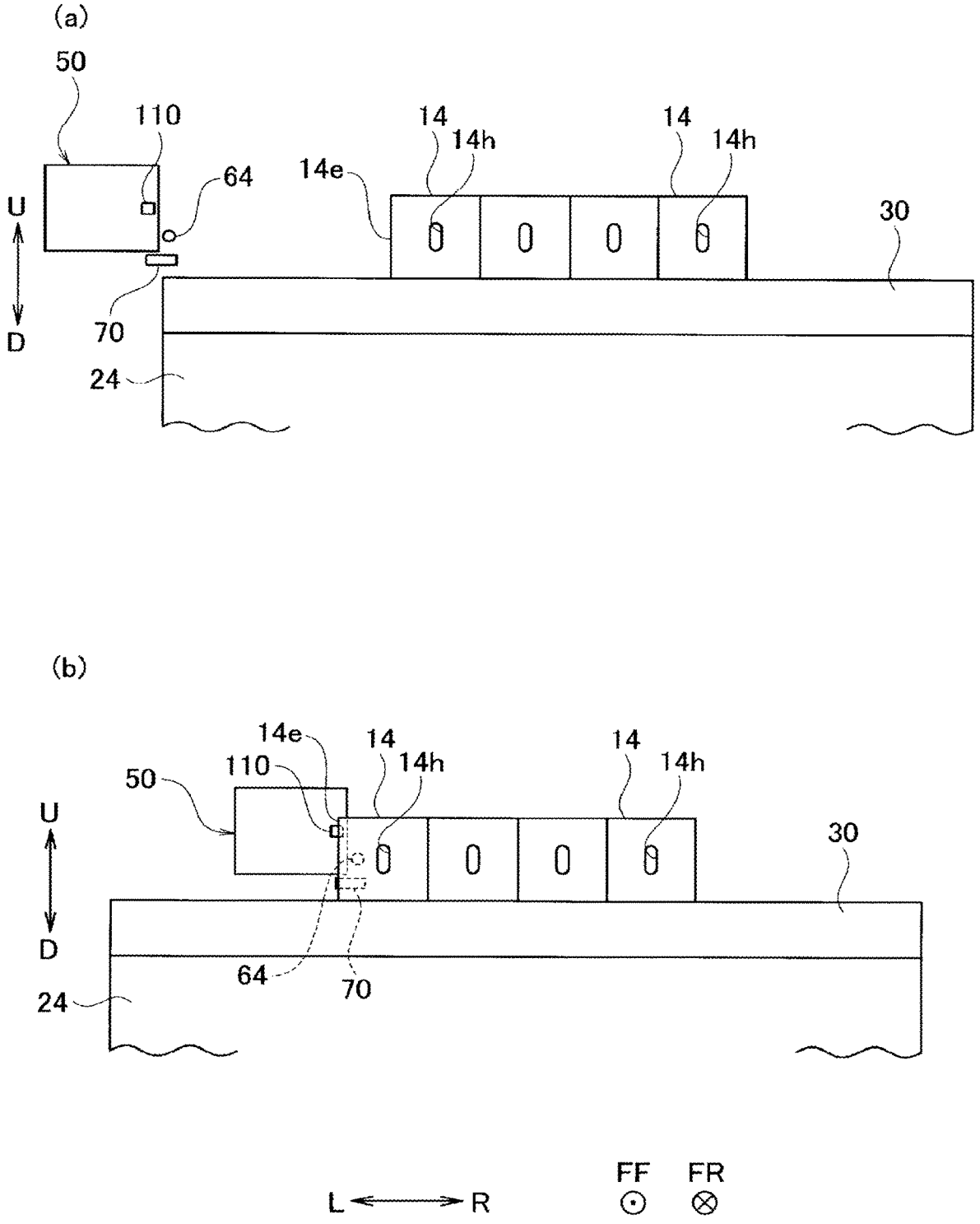
FIGS. 12A(a) and 12A(b) are schematic diagrams illustrating a layout process of the lower tool exchange unit and the like according to the second embodiment.
Figure 12B:
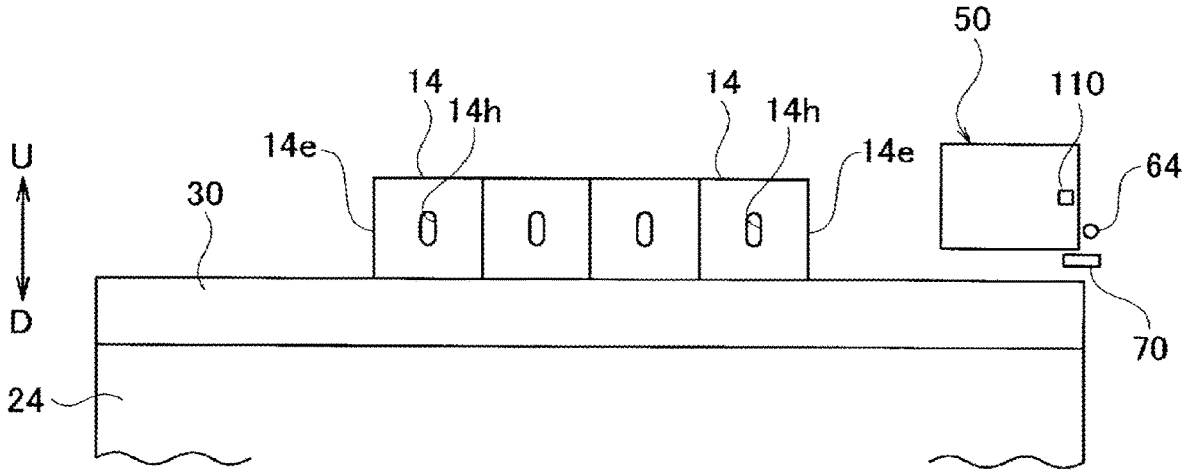
FIGS. 12B(a) and 12B(b) are schematic diagrams illustrating a layout process of the lower tool exchange unit and the like according to the second embodiment.
Figure 12B:
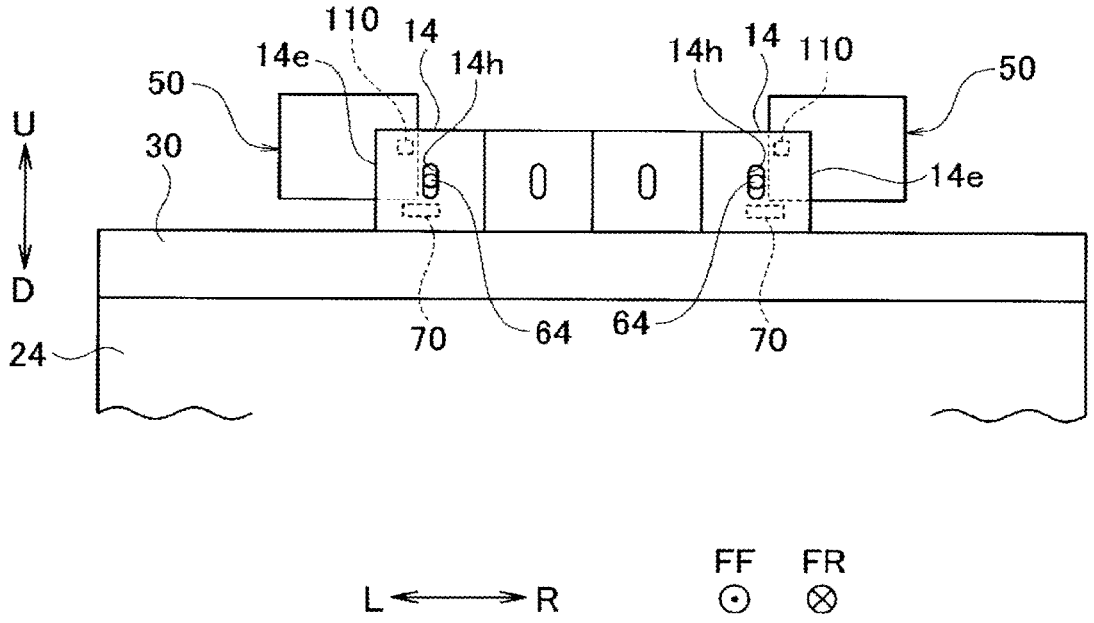

The layout control unit 118 controls the servo motors 52 so that the lower tool exchange units 50 move in the left-right direction (for example, in the right direction) relative to the lower table 24 from the side of the lower table 24 (see FIGS. 12A(a) and 12A(b) and FIG. 12B(a)). After that, based on acquired positions of the centers of the engagement holes 14*h* of the plurality of die tools 14 in the left-right direction and tool layout information about the plurality of die tools 14, the layout control unit 118 controls the lower tool exchange units 50 to lay out again the plurality of die tools 14 at regular arrangement positions on the lower tool holder 30 (see FIG. 12B(b)). Alternatively, based on the positions of centers of the engagement holes 14*h* of the plurality of die tools 14 in the left-right direction and tool layout information about the plurality of die tools 14 on a lower stocker 44, the layout control unit 118 controls the lower tool exchange units 50 to remove the plurality of die tools 14 from the lower tool holder 30 and lay out them at regular arrangement positions on the lower stocker 44 as necessary.

If the clamp plate 36 is accidentally released after a plurality of punch tools 12 are fitted to the upper tool holder 34, the layout control unit 118 also executes a layout process of the upper tool exchange units 74 and the like similarly to the above.

Next, operation and effects of the second embodiment will be explained.

If the operation of retaining a die tool 14 by one of the lower tool retention members 64 fails in the case of transporting the die tools 14 from the lower tool holder 30 to a lower stocker 44 positioned at the lower tool exchange position (see FIG. 11A(a)), the following operation is performed.

Immediately after an alarm occurs, while referring to the database 96, the tool information acquisition unit 102 acquires tool information about the die tool 14 including a relative position of the engagement hole 14*h* of the die tool 14, based on identification information about the die tool 14 from the two-dimensional code reader 70. Then, the retry control unit 116 controls the servo motor 52 to cause the lower tool exchange unit 50 to move in the left-right direction (for example, in the left direction) relative to the lower table 24 by an amount corresponding to the relative position of the engagement hole 14*h* of the die tool 14 (see FIG. 11A(a)). The tool information acquisition unit 102 may acquire tool information about the die tool 14 based on a detection result from the encoder 54 at the time of the occurrence of the alarm and layout information about the die tool 14.

Next, the retry control unit 116 controls the servo motor 52 to cause the lower tool exchange unit 50 to move in the left-right direction (for example, in the right direction) from the side of the die tool 14 while monitoring detection results from the encoder 54 (see FIG. 11A(b)). Further, during the movement of the lower tool exchange unit 50, the photoelectric sensor 110 emits an inspection beam B and detects the end face 14*e* of the die tool 14 from a result of receiving a reflected beam of the inspection beam B (see FIG. 11B(a)). Then, based on a position of the lower tool exchange unit 50 in the left-right direction at the time of the end face 14*e* of the die tool 14 being detected, acquired tool information about the die tool 14 and the like, the hole position acquisition unit 114 acquires a position of the center of the engagement hole 14*h* of the die tool 14 in the left-right direction.

Figure 11B:
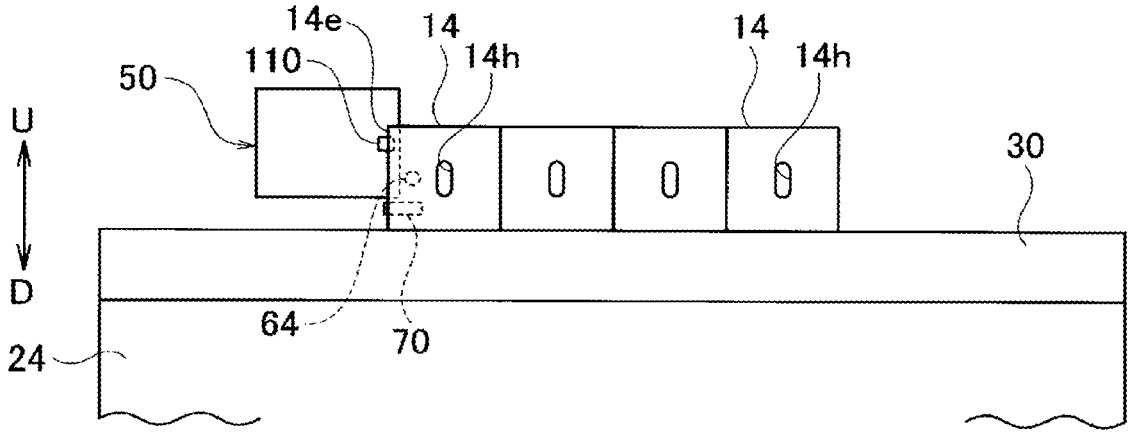
FIGS. 11B(a) and 11B(b) are schematic diagrams illustrating a retry process of the lower tool exchange unit and the like according to the second embodiment.
Figure 11B:
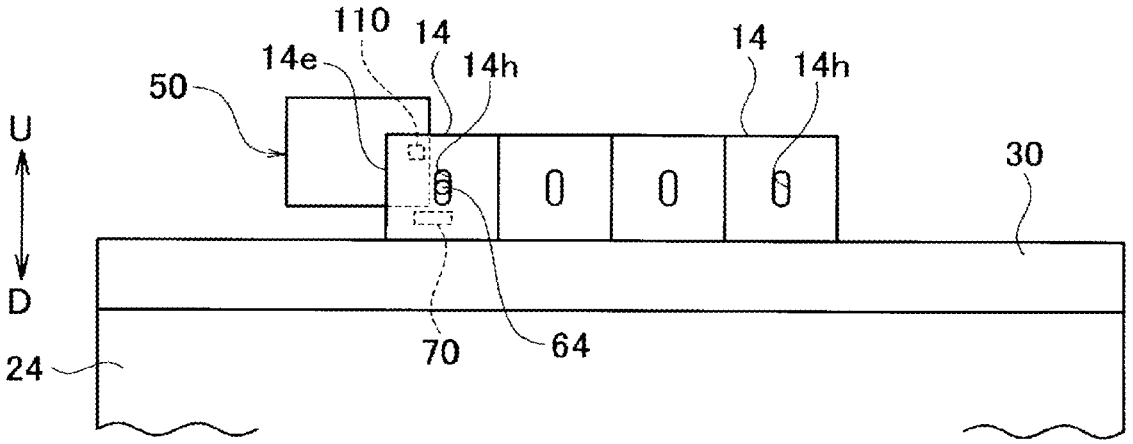
Figure 11B:
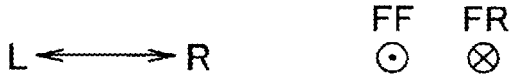

After that, based on the acquired position of the center of the engagement hole 14*h* of the die tool 14 in the left-right direction, the retry control unit 116 controls the lower tool exchange unit 50 to retry the operation of retaining the die tool 14 by the lower tool retention member 64 (see FIG. 11B (b)). Thereby, it is possible to continue the operation related to the transportation of the die tools 14 by the lower tool exchange units 50.

If the operation of retaining a punch tool 12 by one of the upper tool retention members 88 fails in the case of transporting punch tools 12 from the upper tool holder 34 to an upper stocker 46 positioned at the upper tool exchange position, an operation similar to the above is also performed. Thereby, it is possible to continue the operation related to the transportation of the punch tools 12 by the upper tool exchange units 74.

In a case where the clamper 32 is accidentally released after a plurality of die tools 14 are fitted to the lower tool holder 30, a case where a plurality of die tools 14 are randomly fitted to the lower tool holder 30, or the like, the following operation is performed.

The layout control unit 118 controls the servo motors 52 to cause the lower tool exchange units 50 to move in the left-right direction (for example, in the right direction) relative to the lower table 24 from the side of the lower table 24 (see FIGS. 12A(a) and 12A(b) and FIG. 12B(a)). During the movements of the lower tool exchange units 50, the photoelectric sensors 110 emit inspection beams B and detect the end face 14*e* of a die tool 14 on the left end side from results of receiving reflected beams of the inspection beams B. The tool information acquisition unit 102 acquires tool information about the plurality of die tools 14 (width dimensions of the die tools 14 in the left-right direction and relative positions of the centers of the engagement holes 14*h*). Further, based on positions of the lower tool exchange units 50 in the left-right direction at the time of the end face 14*e* of the die tool 14 on the left end side being detected, the acquired tool information about the plurality of die tools 14 and the like, the hole position acquisition unit 114 acquires positions of the centers of the engagement holes 14*h* of the plurality of die tools 14 in the left-right direction (see FIG. 12A(b)). Thereby, the bending system 10 can recognize an actual layout state of the plurality of die tools 14 on the lower tool holder 30.

After that, based on the acquired positions of the centers of the engagement holes 14*h* of the plurality of die tools 14 in the left-right direction and tool layout information about the plurality of die tools 14, the layout control unit 118 controls the lower tool exchange units 50 to lay out again the plurality of die tools 14 at regular arrangement positions on the lower tool holder 30 (see FIG. 12B(b)). Alternatively, based on the acquired positions of the centers of the engagement holes 14*h* of the plurality of die tools 14 in the left-right direction and tool layout information about the plurality of die tools 14 on a lower stocker 44, the layout control unit 118 controls the lower tool exchange units 50 to remove the plurality of die tools 14 from the lower tool holder 30 and lay out them at regular arrangement positions on the lower stocker 44. Thereby, it is possible to continue the operation related to the transportation of the die tools 14 by the lower tool exchange units 50.

If there are gaps among the plurality of die tools 14 during the movements of the lower tool exchange units 50, the photoelectric sensors 110 detect the end faces 14*e* of die tool 14 on the middle side. The bending system 10 can determine whether there are gaps among the plurality of die tools 14, based on tool layout information about the plurality of die tools 14.

In a case where the clamp plate 36 is accidentally released after a plurality of punch tools 12 are fitted to the upper tool holder 34, a case where a plurality of punch tools 12 are randomly fitted to the upper tool holder 34, or the like, an operation similar to the above is also performed. Thereby, it is possible to continue the operation related to the transportation of the punch tools 12 by the upper tool exchange units 74.

In short, according to the second embodiment, based on positions of the lower tool exchange units 50 in the left-right direction at the time of the end faces 14*e* of die tools 14 being detected by the photoelectric sensors 110, and the like, the hole position acquisition unit 114 acquires positions of the centers of the engagement holes 14*h* of the die tools 14 in the left-right direction by calculation, as mentioned above. Based on positions of the upper tool exchange units 74 in the left-right direction at the time of the end faces 12*e* of punch tools 12 being detected by the photoelectric sensors 112 and the like, the hole position acquisition unit 114 acquires positions of the centers of the engagement holes 12*h* of the punch tools 12 in the left-right direction. Further, the tool information acquisition unit 102 acquires tool information about die tools 14 based on identification information about the die tools 14 from the two-dimensional code readers 70. The tool information acquisition unit 102 acquires tool information about punch tools 12 based on identification information about the punch tools 12 from the two-dimensional code readers 94. Thereby, the bending system 10 can accurately recognize actual positions of the engagement holes 14*h* of a plurality of die tools 14 in the left-right direction on the lower tool holder 30 and actual positions of the engagement holes 12*h* of a plurality of punch tools 12 in the left-right direction on the upper tool holder 34.

Therefore, according to the second embodiment, it is possible to stabilize automatic operation of the bending system 10 without the operation related to transportation of die tools 14 by the lower tool exchange units 50 and the like being interrupted in the middle of the operation and the like.

Third Embodiment

Figure 13:
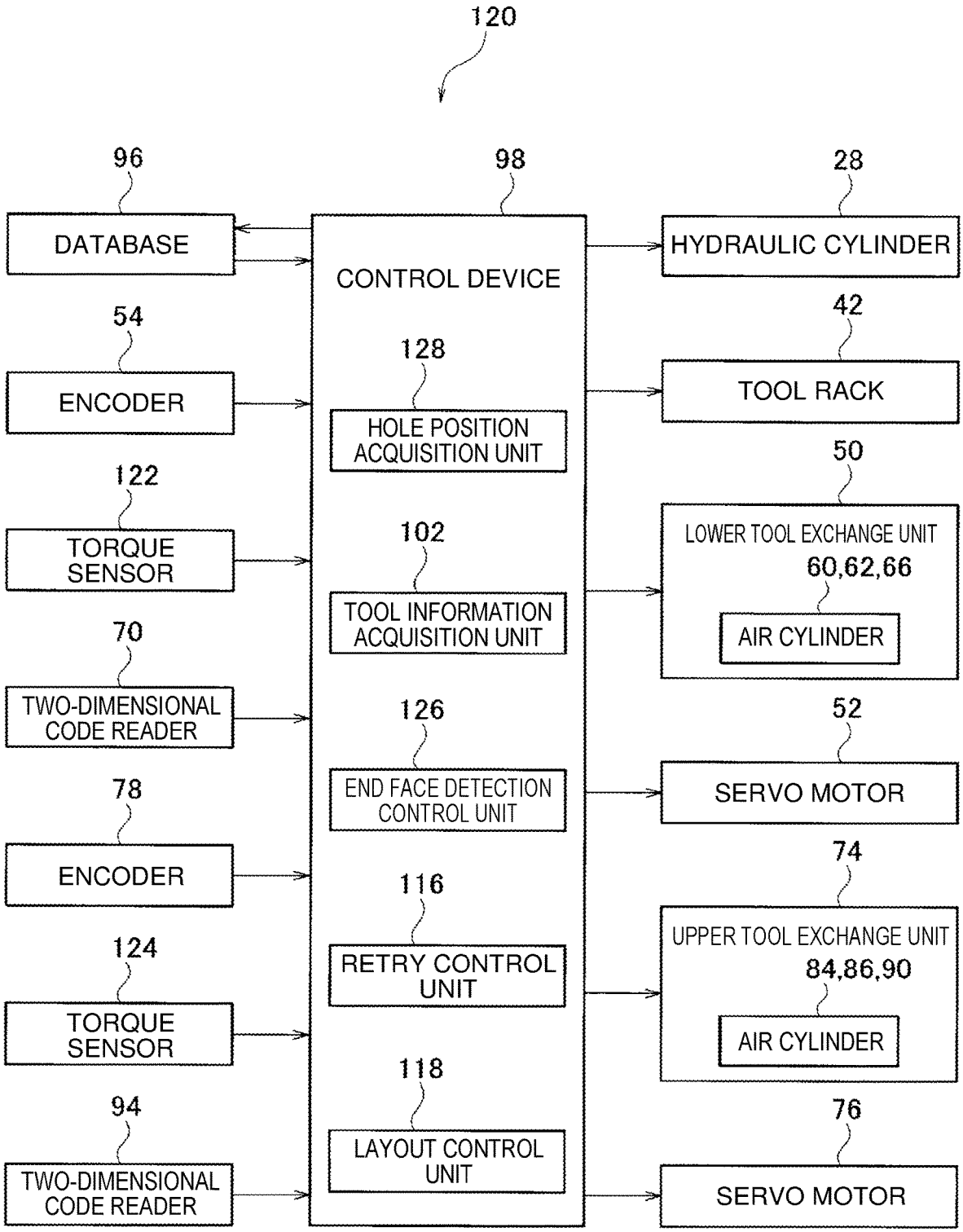
FIG. 13 is a control block diagram of a bending system according to a third embodiment.

As shown in FIG. 13, a bending system 120 according to a third embodiment uses torque sensors 122 to detect torques of the servo motors 52 as end face detectors to detect the end faces 14*e* of die tools 14, instead of the photoelectric sensors 110 (see FIG. 6). Each torque sensors 122 is configured to detect the end face 14*e* of a die tool 14 when a detected torque of its corresponding servo motor 52 (a detection result) exceeds a predetermined threshold. Similarly, the bending system 120 uses torque sensors 124 to detect torques of servo motors 75 as end face detectors to detect the end faces 12*e* of punch tools 12, instead of the photoelectric sensors 112 (see FIG. 6). Each torque sensor 124 is configured to detect the end face 12*e* of a punch tool 12 when a detected torque of the servo motor 75 exceeds a predetermined threshold.

In the third embodiment, the control device 98 has an end face detection control unit 126 and has a hole position acquisition unit 128 instead of the hole position acquisition unit 100 (see FIG. 6). Specific content of functions of the end face detection control unit 126 is as below.

Figure 14:
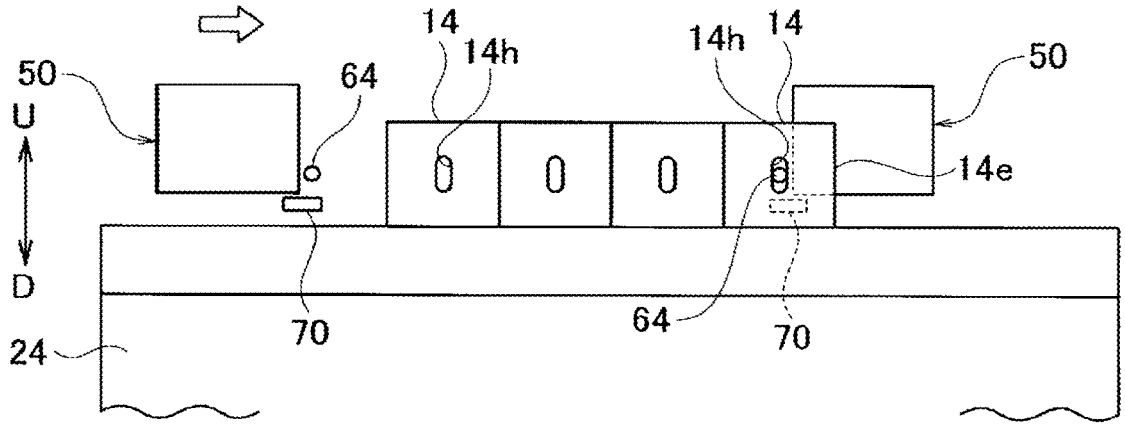
FIGS. 14(*a*) and 14(*b*) are schematic diagrams illustrating a process of detecting an end face of a die tool in the third embodiment.
Figure 14:
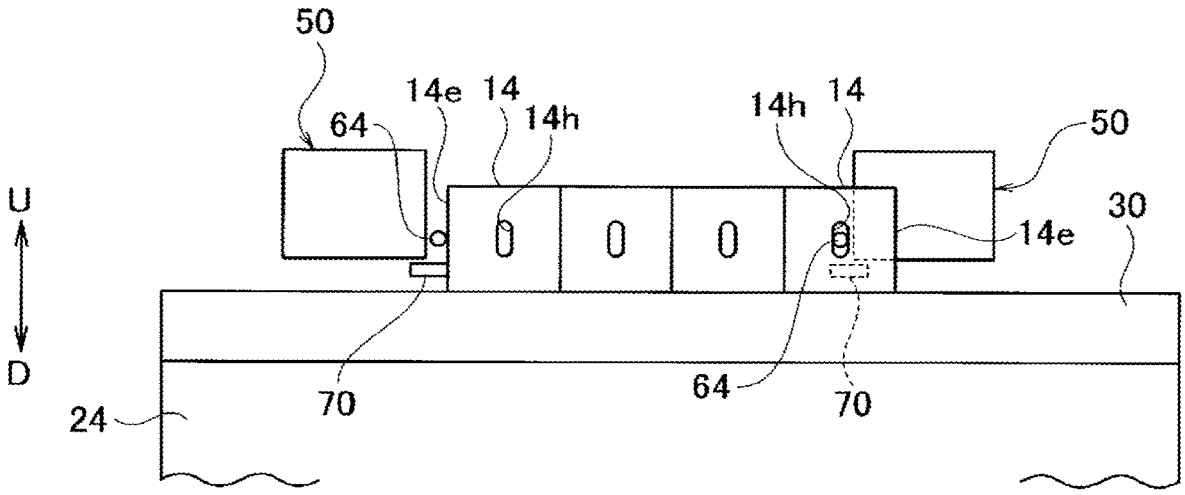

As shown in FIGS. 13 and 14, before detecting the end faces 14*e* of die tools 14, the end face detection control unit 126 controls one lower tool exchange unit 50 so that one lower tool retention member 64 faces an end face 14*e* on one side of the die tools 14 (for example, an end face on the left side) in the left-right direction (see FIG. 14(*a*)). Further, before detecting the end face 14*e* on the one side of the die tools 14, the end face detection control unit 126 controls the other lower tool exchange unit 50 so that the other lower tool retention member 64 retains an engagement hole 14*h* on the other side of the die tools 14, or the retention state is continued (see FIGS. 14(*a*) and (*b*)). Alternatively, before detecting the end face 14*e* on the one side of the die tools 14, the end face detection control unit 126 controls the other lower tool exchange unit 50 so that the other lower tool retention member 64 is in contact with or close to the end face 14*e* on the other side (for example, an end face on the right side) of the die tools 14.

Similarly, before detecting the end faces 12*e* of punch tools 12, the end face detection control unit 126 controls one upper tool exchange unit 74 so that one upper tool retention member 88 faces an end face 12*e* on one side of the punch tools 12 (for example, an end face on the left side) in the left-right direction. Further, before detecting the end face 12*e* on the one side of the punch tools 12, the end face detection control unit 126 controls the other upper tool exchange unit 74 so that the other upper tool retention member 88 retains the engagement hole 12*h* of a punch tool 12, or the retention state is maintained. Alternatively, before detecting the end face 12*e* on the one side of the punch tools 12, the end face detection control unit 126 controls the other upper tool exchange unit 74 so that the other upper tool retention member 88 is in contact with or close to an end face 12*e* on the other side (for example, an end face on the right side) of the punch tools 12.

Based on a position of the one lower tool exchange unit 50 in the left-right direction at the time of the end face 14*e* on the one side of the die tools 14 being detected, and acquired tool information about the die tool 14 (a relative position of the engagement hole 14*h* of the die tool 14), the hole position acquisition unit 128 acquires a position of the center of the engagement hole 14*h* of the die tool 14 in the left-right direction by calculation. The hole position acquisition unit 128 acquires the position of the center of the engagement hole 14*h* of the die tool 14 in the left-right direction in consideration of a relative position of the one lower tool retention member 64 relative to the lower unit body 56. Similarly, based on a position of the one upper tool exchange unit 74 in the left-right direction at the time of the end face 12*e* on the one side of the punch tools 12 being detected, and acquired tool information about the punch tool 12 (a relative position of the engagement hole 12*h* of the punch tool 12), the hole position acquisition unit 128 acquires a position of the center of the engagement hole 12*h* of the punch tool 12 in the left-right direction by calculation. The hole position acquisition unit 128 acquires the position of the center of the engagement hole 12*h* of the punch tool 12 in the left-right direction in consideration of a relative position of the one upper tool retention member 88 relative to the upper unit body 80.

The bending system 120 performs an operation related to detection of the end faces 14*e* of the die tools 14 as below.

The end face detection control unit 126 controls one lower tool exchange unit 50 so that one lower tool retention member 64 faces one end face 14*e* of a die tool 14 on the left end side in the left-right direction. Further, the end face detection control unit 126 controls the other lower tool exchange unit 50 so that the other lower tool retention member 64 retains the engagement hole 14*h* of a die tool 14 on the right end side, or the retention state is continued (see FIG. 14(*a*)). Alternatively, the end face detection control unit 126 controls the other lower tool exchange unit 50 so that the other lower tool retention member 64 is in contact with or close to the other end face 14*e* of the die tool 14 on the right end side. Then, the retry control unit 116 or a layout control unit 119 controls the servo motors 52 to cause the lower tool exchange units 50 to move in the left-right direction (for example, in the right direction) from the side of the die tools 14 while monitoring detection results from the encoders 54.

Then, the one lower tool retention member 64 comes into contact with the one end face 14*e* of the die tool 14 on the left end side; a detection torque of one servo motor 52 exceeds the predetermined threshold; and one torque sensor 122 detects the one end face 14*e* of the die tool 14 on the left end side (see FIG. 14(*b*)). Based on a position of the one lower tool exchange unit 50 in the left-right direction at the time of the one end face 14*e* of the die tool 14 on the left end side being detected, the hole position acquisition unit 114 acquires a position of the center of the engagement hole 14*h* of the die tool 14 on the left end side in the left-right direction by calculation. Further, in a state of the other lower tool retention member 64 being in contact with the other end face 14*e* of the die tool 14 on the right end side, a detection torque of the other servo motor 52 exceeds the predetermined threshold, and the other torque sensor 122 detects the other end face 14*e* of the die tool 14 on the right end side. Based on a position of the other lower tool exchange unit 50 in the left-right direction at the time of the other end face 14*e* of the die tool 14 on the right end side being detected and the like, the hole position acquisition unit 114 acquires a position of the center of the engagement hole 14*h* of the die tool 14 on the right end side in the left-right direction by calculation.

The bending system 120 performs an operation related to detection of the end face 12*e* of a punch tool 12 similarly to the above.

According to the third embodiment, operation and effects similar to those of the second embodiment described above can be obtained.

Fourth Embodiment

Figure 15:
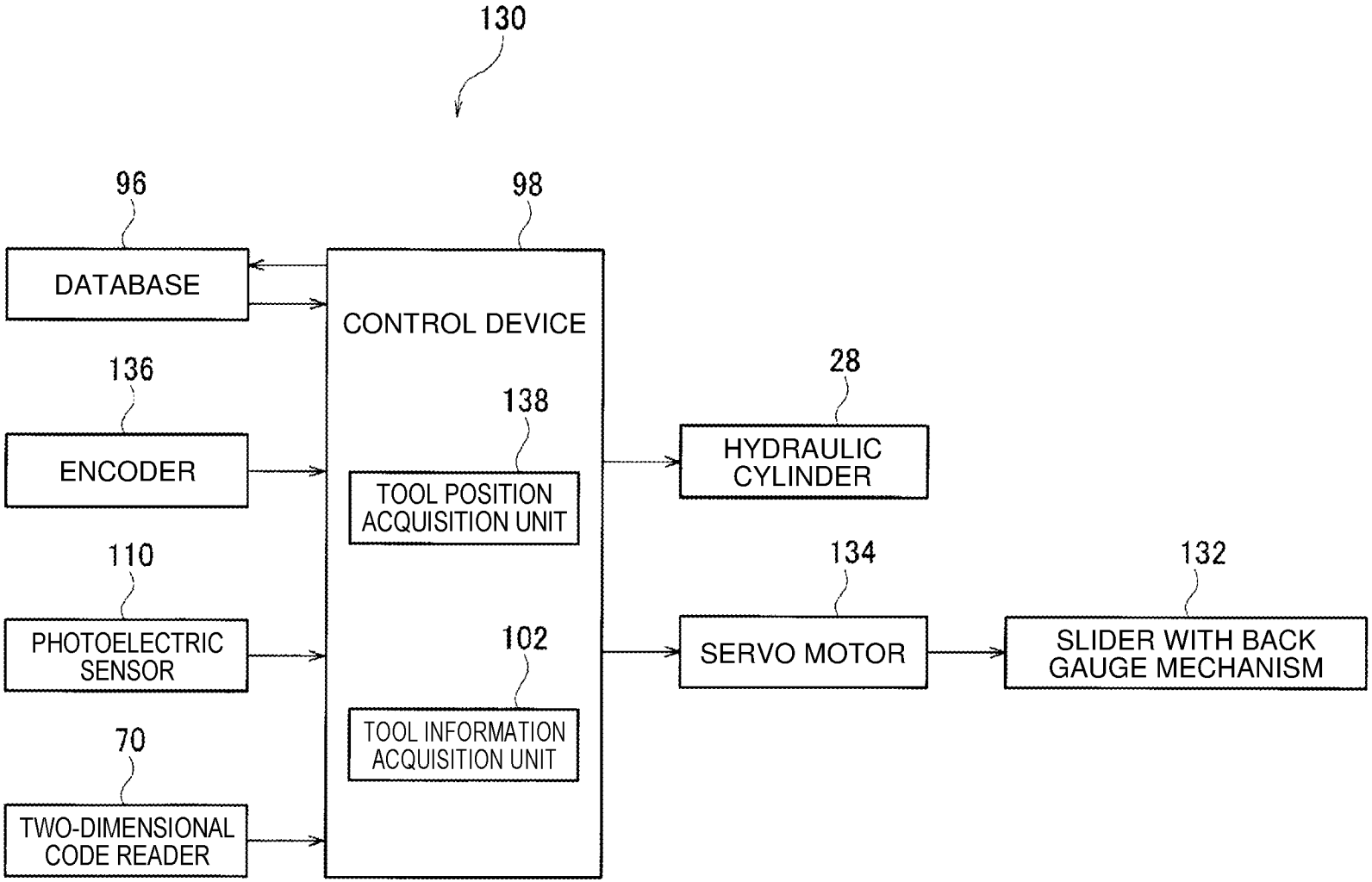
FIG. 15 is a control block diagram of a bending system according to a fourth embodiment.

As shown in FIG. 15, a part of the technical items described in the second embodiment may be applied to a general-purpose bending system 130. The bending system 130 according to a fourth embodiment does not include the tool exchange units 50 or 74 (see FIG. 6), the tool rack 42 (see FIG. 6), the servo motors 52 or 76 (see FIG. 6) or the like. The photoelectric sensors 110 and the two-dimensional code readers 70 are provided at appropriate positions on sliders 132 with back gauge mechanisms as moving bodies, respectively. Servo motors 134 as left-right moving actuators to cause the sliders 132 to move in the left-right direction are connected to the control device 98 of the bending system 130. Encoders 136 as position detectors to detect positions of the sliders 132 in the left-right direction are connected to the control device 98 of the bending system 130.

The control device 98 of the bending system 120 includes a tool position acquisition unit 138 instead of the hole position acquisition unit 114 (see FIG. 6). Based on positions of the sliders 132 in the left-right direction at the time of the end faces 14*e* (see FIG. 9) of die tools 14 being detected, and acquired tool information (width dimensions of the die tools 14 in the left-right direction) about the die tools 14 (see FIG. 1), the tool position acquisition unit 138 acquires positions of the end faces 14*e* of the die tools 14 in the left-right direction by calculation. Similarly, based on positions of the other slider 132 in the left-right direction at the time of the end faces 12*e* (see FIG. 9) of punch tools 12 being detected, and acquired tool information (width dimensions of the punch tools 12 in the left-right direction) about the punch tools 12, the tool position acquisition unit 138 acquires positions of the end faces 12*e* of the punch tools 12 in the left-right direction by calculation. Thereby, the bending system 130 can accurately recognize actual positions of end faces 14*e* of a plurality of die tools 14 in the left-right direction on the lower tool holder 30 (see FIG. 1) and actual positions of end faces 12*e* of a plurality of punch tools 12 in the left-right direction on the upper tool holder 34 (see FIG. 1).

In the fourth embodiment, a die tool 14 does not need to have an engagement hole 14*h*, and a punch tool 12 does not need to have an engagement hole 12*h*.

The present disclosure is not limited to the explanations of the first to fourth embodiment described above. For example, the present disclosure can be implemented in various aspects as below.

As hole detectors to detect the engagement holes 14*h* of die tools 14, cameras to pick up images of the engagement holes 14*h* of the die tools 14 may be used instead of using the photoelectric sensors 68. In this case, using a reference image for the engagement holes 14*h* of the die tools 14, the hole position acquisition unit 100 judges whether a picked-up image corresponds to the reference image or not by pattern matching. Similarly, as hole detectors to detect the engagement hole 12*h* of punch tools 12, cameras to pick up images of the engagement holes 12*h* of the punch tools 12 may be used instead of using the photoelectric sensors 92.

Instead of providing the identification marks 14*m* to a die tool 14, an IC chip storing tool information about the die tool 14 may be attached. Similarly, instead of providing the identification marks 12*m* to a punch tool 12, an IC chip storing tool information about the punch tool 12 may be attached. In this case, an IC chip reader as an information reader reads the tool information about the die tool 14 and the tool information about the punch tool 12.

The photoelectric sensors 68 (or 108) and the two-dimensional code readers 70 may be provided on sliders 132 (see FIG. 15) with back gauge mechanisms as moving bodies provided on the back side of the lower table 24 being movable in the left-right direction, instead of being provided on the lower tool exchange units 50. Alternatively, the photoelectric sensors 68 (or 108) and the two-dimensional code readers 70 may be provided on bending indicators (not shown) as moving bodies provided on the front side of the lower table 24 being movable in the left-right direction.

The operation related to tool exchange may be performed by a tool change robot (not shown) instead of performing the operation related to tool exchange by the lower tool exchange units 50 and the upper tool exchange units 74.

The scope of rights included in the present invention is not limited to the first to fourth embodiments described above.

The present disclosure is related to the subjects described in Japanese Patent Application 2019-107126 filed on Jun. 7, 2019 and Japanese Patent Application 2020-093079 filed on May 28, 2020, the disclosed content of which is incorporated herein by reference in its entirety.

The invention claimed is:

1. A bending system comprising:

a press brake including a table and a tool holder provided on the table, a plurality of tools being fitted to the tool holder;

a tool changer provided on a back side or a front side of a table of the press brake so as to be movable in a left-right direction via a guide extending in the left-right direction;

a moving actuator configured to cause the tool changer to move in the left-right direction relative to the table;

a position detector configured to detect a position of the tool changer in the left-right direction;

a hole detector configured to detect an engagement hole for causing a hook of the tool changer to be engaged and disengaged, the engagement hole being a part of a tool of the plurality of tools fitted to the tool holder provided on the table; and a control device including a memory and a CPU, wherein the CPU is configured to acquire a position of the engagement hole of the tool in the left-right direction, based on the position of the tool changer in the left-right direction at the time of the engagement hole of the tool being detected, wherein the hole detector is a photoelectric sensor that is provided on the tool changer, and the hole detector and the engagement hole of the tool are located at a same height as one another when the tool is fitted to the tool holder provided on the table, and the hole detector is configured, during a movement of the tool changer in the left-right direction, to emit an inspection beam to the engagement hole of the tool and to detect the engagement hole of the tool from a result of receiving a reflected beam of the inspection beam.

2. The bending system according to claim 1, further comprising:

an information reader provided on the tool changer, the information reader being configured to read, from a storage medium provided to the tool, tool information including a width dimension of the tool in the left-right direction and a relative position of the engagement hole in the tool.

3. The bending system according to claim 1, wherein the CPU is configured to, if an operation of retaining the tool by the hook fails, control the moving actuator so that the tool changer moves in the left-right direction relative to the table and to control the tool changer to retry the operation of retaining the tool by the hook based on the position of the engagement hole of the tool in the left-right direction acquired during the movement of the tool changer.

4. The bending system according to claim 1, wherein the CPU is configured to control the moving actuator so that the tool changer moves in the left-right direction relative to the table and, based on the position of the engagement hole of the tool in the left-right direction acquired during the movement of the tool changer, and tool layout information about the tool, to control the tool changer to position the tool on the tool holder.

5. The bending system according to claim 1, wherein the CPU is configured to control the moving actuator so that the tool changer moves in the left-right direction relative to the table and, based on the position of the engagement hole of the tool in the left-right direction acquired during the movement of the tool changer, and tool layout information about the tool on a stocker in a tool rack, to control the tool changer to cause the tool to be removed from the tool holder and store the tool on the stocker.

6. The bending system according to claim 1, wherein the tool changer is configured to transport the tool between the tool holder and a stocker in a tool rack.

* * * * *